US010947812B2

(12) United States Patent
George et al.

(10) Patent No.: US 10,947,812 B2
(45) Date of Patent: Mar. 16, 2021

(54) WIRELINE WELL ABANDONMENT TOOL

(71) Applicant: WIRELINE ABANDONMENT CORP., Calgary (CA)

(72) Inventors: Grant George, Calgary (CA); Peter Knight, Calgary (CA)

( * ) Notice: Subject to any disclaimer, the term of this patent is extended or adjusted under 35 U.S.C. 154(b) by 105 days.

(21) Appl. No.: 16/342,180

(22) PCT Filed: Oct. 16, 2017

(86) PCT No.: PCT/CA2017/051228
§ 371 (c)(1),
(2) Date: Apr. 15, 2019

(87) PCT Pub. No.: WO2018/068154
PCT Pub. Date: Apr. 19, 2018

(65) Prior Publication Data

US 2019/0323307 A1 Oct. 24, 2019

Related U.S. Application Data

(60) Provisional application No. 62/408,178, filed on Oct. 14, 2016.

(51) Int. Cl.

| | |
|---|---|
| ***E21B 33/134*** | (2006.01) |
| ***E21B 23/06*** | (2006.01) |
| ***E21B 33/12*** | (2006.01) |
| *E21B 7/20* | (2006.01) |

(Continued)

(52) U.S. Cl.
CPC ..... *E21B 33/134* (2013.01); *E21B 23/06* (2013.01); *E21B 33/12* (2013.01); *E21B 7/20* (2013.01); *E21B 47/024* (2013.01); *E21B 47/12* (2013.01)

(58) Field of Classification Search
CPC ..... E21B 33/134; E21B 33/12; E21B 23/06
See application file for complete search history.

(56) References Cited

U.S. PATENT DOCUMENTS

| | | | | |
|---|---|---|---|---|
| 2,189,937 A | | 2/1940 | Broyles | |
| 2,701,614 A | * | 2/1955 | Ragan | E21B 23/065 166/63 |
| 2,978,029 A | | 4/1961 | O'Reilly et al. | |

(Continued)

FOREIGN PATENT DOCUMENTS

| | | |
|---|---|---|
| CN | 103452526 | 6/2016 |

*Primary Examiner* — D. Andrews
(74) *Attorney, Agent, or Firm* — Richard D. Okimaw

(57) ABSTRACT

A well abandonment tool comprising an elongate housing extending between top and bottom ends locatable within a wellbore having a longitudinal pumping cylindrical bore with a pumping piston therein. The apparatus further comprises a wellbore seal located around the housing operable to engage upon the wellbore and to be expanded into contact therewith upon an upward motion of the housing so as to seal an annulus between the housing and the wellbore and a bridge plug engagement connector adapted to secure a bridge plug thereto at a position below the bottom end of the housing. The pumping piston is suspended from a wireline wherein longitudinal movement of the pumping piston discharges a fluid into a bridge plug activation chamber having a movable cylinder adapted to draw the bridge plug engagement connector against the bottom end of the housing so as to expand the bridge plug into engagement with the wellbore.

25 Claims, 33 Drawing Sheets

(51) Int. Cl.
*E21B 47/024* (2006.01)
*E21B 47/12* (2012.01)

(56) References Cited

U.S. PATENT DOCUMENTS

| | | | | |
|---|---|---|---|---|
| 3,460,618 | A | 8/1969 | Blagg | |
| 3,556,215 | A | 1/1971 | Owens | |
| 7,681,651 | B2 | 3/2010 | Loughlin | |
| 2019/0249513 | A1* | 8/2019 | Yu | E21B 23/06 |
| 2019/0368293 | A1* | 12/2019 | Covalt | E21B 23/065 |

* cited by examiner

WIRELINE WELL ABANDONMENT TOOL

BACKGROUND OF THE INVENTION

1. Field of Invention

The present invention relates generally to containment and sealing of suspended oil wells and gas wells and more specifically to downhole tools for setting and pressure testing wellbore sealing plugs during sealing and abandonment of oil wells and gas wells, and to methods for use of said tools.

2. Description of Related Art

Recovery of hydrocarbon-rich crude oil and/or gas from subterranean deposits is accomplished through wellbores that have been drilled into the deposits from the earth's surface. Before crude oil and/or gas can be extracted from a subterranean deposit, the wellbore must be "completed" so that the hydrocarbon-rich materials can be removed from the deposit without leakage into the subterranean zones between the deposit, potable surface ground water, and the earth's surface. Completion of a wellbore and making it production ready for extraction of the hydrocarbon-rich material generally involves: (i) inserting an outer casing into the wellbore so that it terminates at about the region below the deposit, (ii) cementing the space, also referred to as the "annulus", between the casing and the wellbore, (iii) perforating the production casing to expose the hydrocarbon rich material in the region to the inside of the casing, and (iv) inserting a narrower diameter "production tubing" through the casing until it terminates within the subterranean deposit, to allow the hydrocarbon rich material to flow to surface.

All wells have an operational lifetime after which they become: (i) unproductive due to depletion of the hydrocarbon-rich material, or alternatively, (ii) unprofitable to operate due to fluctuations in the global prices for crude oil and/or gas in combination with the operations costs required to keep a well in production. Such conditions can result in decisions to shut-in producing wells, i.e., to cease pumping operations. Three months after a well is shut-in, it is referred to as a "suspended well".

Most jurisdictions have regulations in place that stipulate the procedures that must be followed to close and seal suspended or shut-in wells to minimize as much as possible any leakage and/or seepage of remaining subterranean hydrocarbon-rich materials into other zones between the deposits and the earth's surface, and in particular, to prevent the contamination of aquifers and ground water.

However, there is an enormous backlog of suspended wells that have not been sealed or which have been improperly sealed, in most hydrocarbon-producing regions around the world. Alberta Environment and Parks estimated in 2014 that there were over 50,000 suspended oil and gas wells in that Province (http://global news.ca/news/2307275/interactive-the-hidden-cost-of-abandoned-oil-and-gas-wells-in-alberta/). Wells that have not been abandoned about ten years after they were suspended become a government responsibility and liability, and are considered to be "orphan wells". The downturn in global oil prices in 2014-2015 resulted in the shut-in of over 500 wells in Alberta during 2015 with another 1,200 new orphan wells identified in 2016 that were licensed to defunct Alberta licensees (according to the Orphan Well Association). In other jurisdictions, State agencies report that over 6,800 orphan wells are known to exist in Texas, and that there are nearly 1,000 orphan wells in California.

The Alberta Energy Regulator issued Directive 20 in March 2016 that set out the requirements for abandoning shutdown wells (https://www.aer.ca/rules-and-regulations/directives/directive-020). The current requirements for sealing Level-A intervals in completed wells specify three options for sealing a production casing or tubing wherein: (i) the first option comprises setting a cement retainer within 15 m of the perforations in a production zone, (ii) the second option is setting a cement squeeze into the perforations in a production zone and must extend a minimum of 15 vertical metres below the completed interval and a minimum of 30 vertical metres above the completed interval, and (iii) the third option is setting a plug in a permanent bridge plug within 15 m of the perforations in a production zone. Regardless of which option is selected for sealing the production casing, the plug must be pressure tested at stabilized pressure of 7000 kPa for 10 min. In the case of first option, if the cement retainer passes the pressure test, then a cement squeeze must be conducted through the retainer followed by capping with class "G" cement that is a minimum of 30 vertical metres. In the case of the third option, if the permanent bridge plug passes the pressure test, then it must be capped with 60 vertical metres of class "G" cement.

The current requirements for non-level A wells specify four options for sealing a production casing wherein: (i) the first option comprises setting a permanent bridge plug within 15 m of the perforations in a production zone, (ii) the second option is setting a cement retainer within 15 m of the perforations in a production zone, (iii) the third option is setting a plug in a permanent packer within 15 m of the perforations in a production zone, and (iv) the fourth option is setting a cement plug across the perforations in a production zone wherein the cement plug must extend a minimum of 15 vertical metres below the completed interval and a minimum of 15 vertical metres above the completed interval. Regardless of which option is selected for sealing the production casing, the plug must be pressure tested at stabilized pressure of 7000 kPa for 10 min. If the plug passes the pressure test, then it must be capped with 8 vertical metres of class "G" cement or alternatively, with a minimum of 3 vertical metres of resin-based low-permeability gypsum cement.

The most common practices for sealing and pressure testing cased and cemented natural gas wells or oil wells use tubing-conveyed packer assemblies to pressure test abandonment Bridge Plugs. This requires deployment of tubing runs into the wells from over-the-road coil casing units or service rigs through which: (i) the sealing materials are delivered and installed, and then (ii) pressure-testing equipment are deployed and recovered. Over-the-road coil tubing units generally comprise a heavy-duty truck chassis with tandem steering and tandem drive axle or alternatively a tridem drive axle, onto which are typically installed a coiled casing package that includes an injector, a coiled tubing reel, a soap pump and tank, a compressor, a picker, a blow-out preventer, and optionally, a control cabin and/or or a telescoping operator's station. To properly service oil and gas wells and to abandon suspended wells, a number of other service rigs are required on site in addition to coil tubing units, including (i) a carrier rig for the derrick, (ii) a pump truck, (iii) a "doghouse" for crew use, and (iv) support trucks with tools, equipment, and power generators. Such combinations of services rigs and over-the-road coil tubing units are expensive to transport and operate, and the cost of their use to seal and test an abandoned well is typically in the range of $10,000 to $20,000 per day.

SUMMARY OF THE INVENTION

According to a first embodiment of the present invention there is disclosed a well abandonment tool comprising an elongate housing extending between top and bottom ends locatable within a wellbore having a longitudinal pumping cylindrical bore therein. The apparatus further comprises a wellbore seal located around the housing operable to engage upon the wellbore and to be expanded into contact therewith upon an upward motion of the housing so as to seal an annulus between the housing and the wellbore and a bridge plug engagement connector adapted to secure a bridge plug thereto at a position below the bottom end of the housing. The apparatus further includes a pumping piston longitudinally moveably located within the pumping cylinder, the pumping piston being suspended from a wireline wherein longitudinal movement of the pumping piston discharges a fluid into a bridge plug activation chamber having a movable cylinder adapted to draw the bridge plug engagement connector against the bottom end of the housing so as to expand the bridge plug into engagement with the wellbore.

The bridge plug engagement connector may include a frangible portion and wherein the bridge plug engagement connector may include a cavity therein through the frangible portion in fluidic communication with the bridge plug activation chamber. The well abandonment tool may further comprise at least one valve adapted to selectably direct the fluid from the pumping cylinder to the bridge plug activation chamber. The at least one valve may be adapted to isolate the fluid within the pumping cylinder so as to prevent movement of the pumping piston therein.

The well abandonment tool may further comprise a testing fluid injector assembly adapted to discharge a quantity of a testing fluid therefrom into a pressurized annulus between the housing and the wellbore and between the wellbore seal and the bridge plug. The testing fluid injector may comprise an injector cylinder having an injector piston therein and a reservoir cylinder having a reservoir piston therein. The reservoir piston may be displaced by the fluid directed to the bridge plug activation chamber so as to pressurize the injector cylinder. The at least one valve may be adapted to selectably direct the fluid to the injector piston so as to displace the piston therein so as to discharge the testing fluid therefrom. The injector cylinder may include a check valve having an opening pressure selected to prevent the discharge of the testing fluid before the bridge plug is set.

The well abandonment tool may further comprise a processing circuit adapted to control the operation of the at least one valve. The processing circuit may be adapted to monitor the pressure within the pressurized annulus and presence of the testing fluid at the test sensors thereabove.

The pumping piston may include a first stage ring selectably secured therearound so as to provide an increased pumping volume when secured thereto. The first stage ring may include a plurality of piston collet arms each having a radially inwardly extending protrusion engaged within an annular piston groove on the pumping piston so as to secure the second stage ring to the pumping piston. Each of the pumping piston collet arms may include a radially outwardly extending protrusion adapted to be engaged within an annular cylinder groove in the pumping cylinder.

The well abandonment tool may further comprise a first stage disengagement wedge ring adapted to be slidably located under the plurality of piston collet arms so as to disengage the inwardly extending protrusions from the annular piston groove and engage the outwardly extending protrusions into the annular cylinder groove. The well abandonment tool may further comprise at least one spring biased second stage piston fluidically connected with the output from the pumping cylinder so as to displace the first stage disengagement wedge ring upon the pumping cylinder reading a predetermined pressure.

The well abandonment tool may further comprise a plurality of slip arms expandable into engagement with the wellbore wall by a cone located around the housing between the slip arms and the wellbore seal. The slip arms may be retained around the housing on a slip arm ring. The slip arm ring may include at least one radially inwardly extending j-pin, wherein the slip arm ring is selectably longitudinally positionable along the housing by rotating the j-pin into alternating short and long longitudinal slots on an outer surface of the housing.

The wellbore seal may be longitudinally compressed between the cone and a wellbore seal backing protrusion extending from the housing. The well abandonment tool may further comprise a wellbore seal retention piston engaged upon a bottom end of the wellbore seal wherein the wellbore retention piston is biased towards the wellbore seal by the pressure of the fluid directed towards the bridge plug engagement chamber.

According to a further embodiment of the present invention there is disclosed a method for abandoning a wellbore comprising locating a housing within a wellbore above a location to be sealed, pulling upwardly on a wireline secured to a pumping piston within the housing so as to draw a bottom end of the housing upwards thereby extending a seal element located along the housing into engagement with the wellbore, pulling upwardly on the wireline so as to displace the pumping piston within a cylindrical bore within the housing so as to discharge a fluid therefrom and directing the discharged fluid into a bridge plug activation chamber adapted to draw a bridge plug engagement connector against a bottom end of the housing so as to expand a bridge plug secured thereon into engagement with the wellbore.

The method of may further comprise further pressurizing the bridge plug activation chamber after the bridge plug is secured so as to shear a frangible portion of the bride plug engagement connector releasing the fluid into a pressurized annulus between the housing and the wellbore between the seal and the bridge plug.

The method may further comprise injecting a quantity of a testing fluid into the pressurized annulus and monitoring above the seal for a presence of the testing fluid. The method may further comprise monitoring a pressure within the pressurized annulus.

According to a further embodiment of the invention, there is disclosed a downhole pressure-testing tool comprising a chassis, a motor securely engaged within the chassis, a pump securely engaged within the chassis and in communication with the motor to provide fluid pressures therefrom and a radially expandable and contractible sealing packing securely engaged within and to the chassis. The sealing packing is expandable with a first pressure and contractible when the first pressure is relieved. The downhole pressure-testing tool further comprises a radially expandable and contractible hydraulic slip or a mechanical slip securely engaged with the chassis and extending outward therefrom and a first set of a pressure sensor and a temperature sensor extending below the pump and wherein the pressure-testing tool is deployable into a production casing from a wireline service truck. The pressure-testing tool is in communication with and controlled by instrumentation provided therefore in the wireline service truck wherein the the pressure-testing tool is sealingly engageable within a production casing with a hydraulic pressure or a mechanical pressure for radially expanding the sealing packing. The pressure-testing tool is configured for providing a second fluid pressure greater than the first fluid pressure to a lower portion of the production casing.

The downhole pressure-testing tool may further comprise a second set of a pressure sensor and a temperature sensor extending above the motor.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention wherein similar characters of reference denote corresponding parts in each view.

DETAILED DESCRIPTION

The embodiments of the present disclosure generally relate to downhole pressure-testing tools that can be deployed into and recovered from a suspended production casing by a wireline service truck for the purposes of testing a sealed, i.e. abandoned, production casing as may be required by government regulations. The pressure-testing tools disclosed herein can be deployed into a production casing and operated therein, and then recovered with a wireline service truck alone if the wireline service truck is additionally fitted with a service rig (i.e. a derrick). Alternatively, the pressure-testing tools may deployed from a wireline service truck into a production casing by way of a derrick deployed from a carrier rig.

One embodiment of a downhole pressure-testing tool disclosed herein comprises a packer pump assembly having one set and optionally, two sets of temperature and pressure sensors. The packer pump assembly generally comprises a chassis within which are mounted a pump, a motor to drive the pump, an expandable/retractable packer seal element for sealingly engaging/disengaging the entire inner circumference of a production casing, and slips to prevent upward movement of the packer pump during a pressure test between the plug and the packer pump assembly. One set of a temperature sensor and a pressure sensor extends below the packer pump assembly while another set of a temperature sensor and a pressure sensor extends above the packer pump assembly. The two sets of temperature and pressure sensors communicate with gauges and monitors located on the wireline service truck. The operation of the motor and pump as well as the deployment and retraction of the packer seal element are controlled from the controls equipment located on the wireline service truck. The pressure testing tool also electronically initiates a setting tool to set the permanent plug eliminating the need to perform two wireline runs to set and pressure test the plug.

The pump component of the packer pump assembly may be any pump suitable for downhole use, for example a mechanical plunger style pump, a fluid pump, and the like. The motor component is an electrical motor that provides a rotational force or a piston force or a fluid-pressure based force, and the like.

Figure 1:
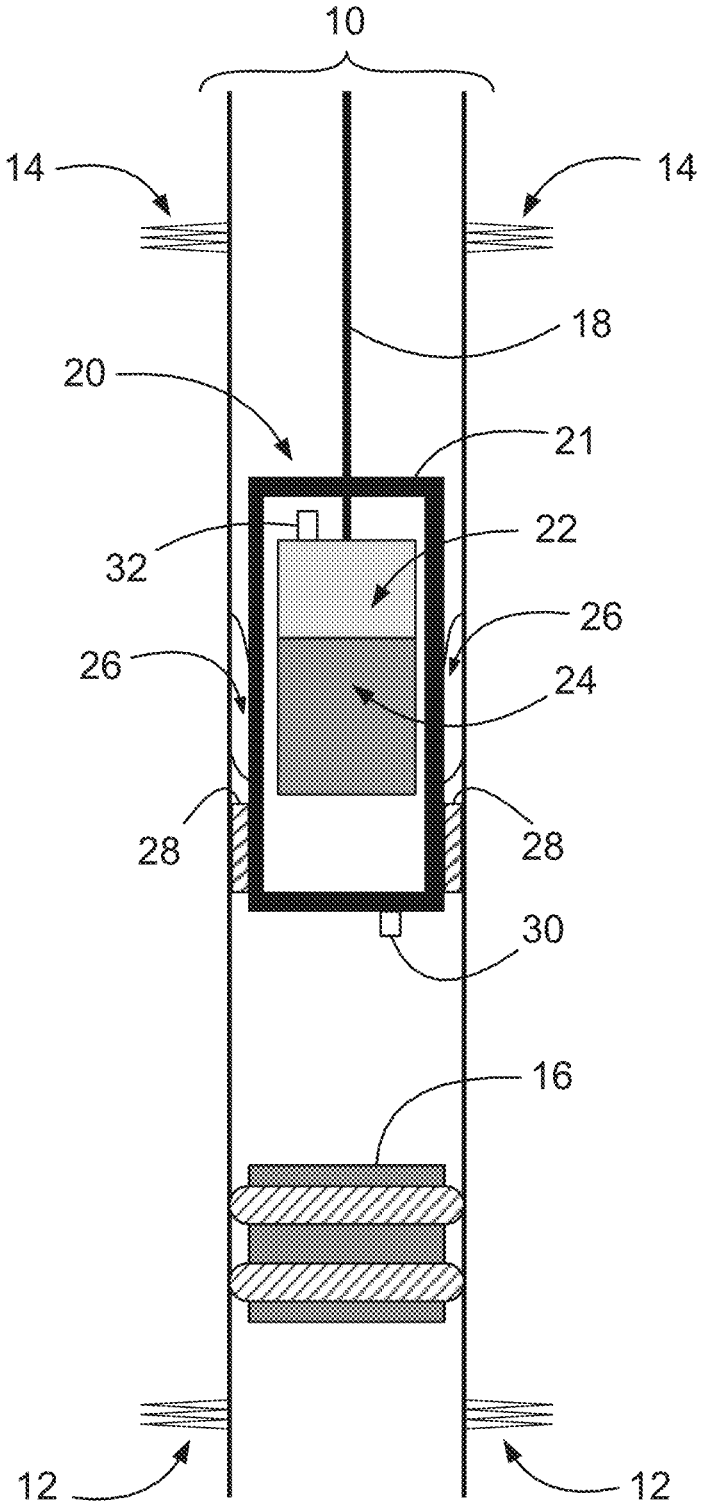
FIG. 1 is a schematic illustration of a wireline pressure-testing tool according to an embodiment of the present disclosure, deployed into a production casing above a permanent bridge plug.

An example of a downhole pressure-testing tool 20 according to an embodiment of the present disclosure is shown in FIG. 1. A production casing 10 is shown for extracting hydrocarbon-rich material from two zones accessible through perforations 12 (lower producing zone) and 14 (upper producing zone). A permanent bridge plug 16 has been set with the pressure-testing tool 20 above the perforations 12 to seal the production casing between the upper and lower producing zones. The pressure-testing tool 20 is positioned within the production casing 10 by a wireline 18 deployed from a wireline service truck (not shown). This pressure-testing tool 20 comprises a chassis 21 within which is engaged a motor 22 and a fluid pump 24. The motor 22 and the fluid pump 24 may be coupled together or alternatively, spaced apart. Also engaged with or alternatively within the chassis 21 is an outwardly expandable/retractable packer seal element 26. Also engaged with or alternatively within the chassis 21 are two or more outward-facing outwardly extendible and retractable slips 28 spaced around the outer circumferential surface of the chassis 21. A first set of pressure and temperature sensors is housed within a leak-proof casing 30 mounted onto and extending downward from the chassis 21. A second set of pressure and temperature sensors may be optionally housed within a leak-proof casing 32 mounted onto or about the top surface of the chassis 21.

The deployment and use of the pressure-testing tool 20 is controlled from a wireline service truck using standard control devices, instruments, and monitors generally following the methods disclosed herein. After the pressure-testing tool 20 is lowered into the production casing 10 to a selected position above the permanent bridge plug 16, the pressure-testing tool 20 is sealed into place by operator-controlled expansion of the packer seal element 26 until it sealingly engages the inner circumference of the production casing 10. Then the motor 22 is started and the pump 24 engaged to pump fluid from the production casing 10 above the pressure-testing tool 20 into the production casing space between the pressure-testing tool 20 and the bridge plug 16 thereby increasing the fluid pressure exerted onto the bridge plug 16. The increasing pressure within the production casing 10 space between the pressure-testing tool 20 and the bridge plug 16 and any changes in temperature are detected by the first set of pressure and temperature sensors housed within casing 30, while the pressure and temperature of the fluid in the production casing 10 above the pressure-testing tool 20 are detected by the second set of pressure and temperature sensors housed within casing 32. The pressure and temperature readings from both sets of sensors are monitored at the surface by the operator. The operation of the motor 22 and pump 24 is continued until the fluid pressure exerted onto the bridge plug 16 reaches a target pressure, for example 7000 kPa. Then, the motor 22 and pump 24 are turned off, and the pressure and temperature readings from both sets of detectors are monitored and recorded for at least 10 minutes to determine if any changes in pressure occur within the space between the pressure-testing tool 20 and the bridge plug 16. If the pressure measured by pressure sensor 30 remains at the target pressure point for the duration of the testing interval, e.g., 10 min, then it is confirmed that the bridge plug 16 has completely and stably sealed the production casing 10. However, if the pressure drops below the target pressure point during the testing interval, then the pressure-testing tool 20 or the bridge plug 16 has to be reset and then retested.

Figure 2:
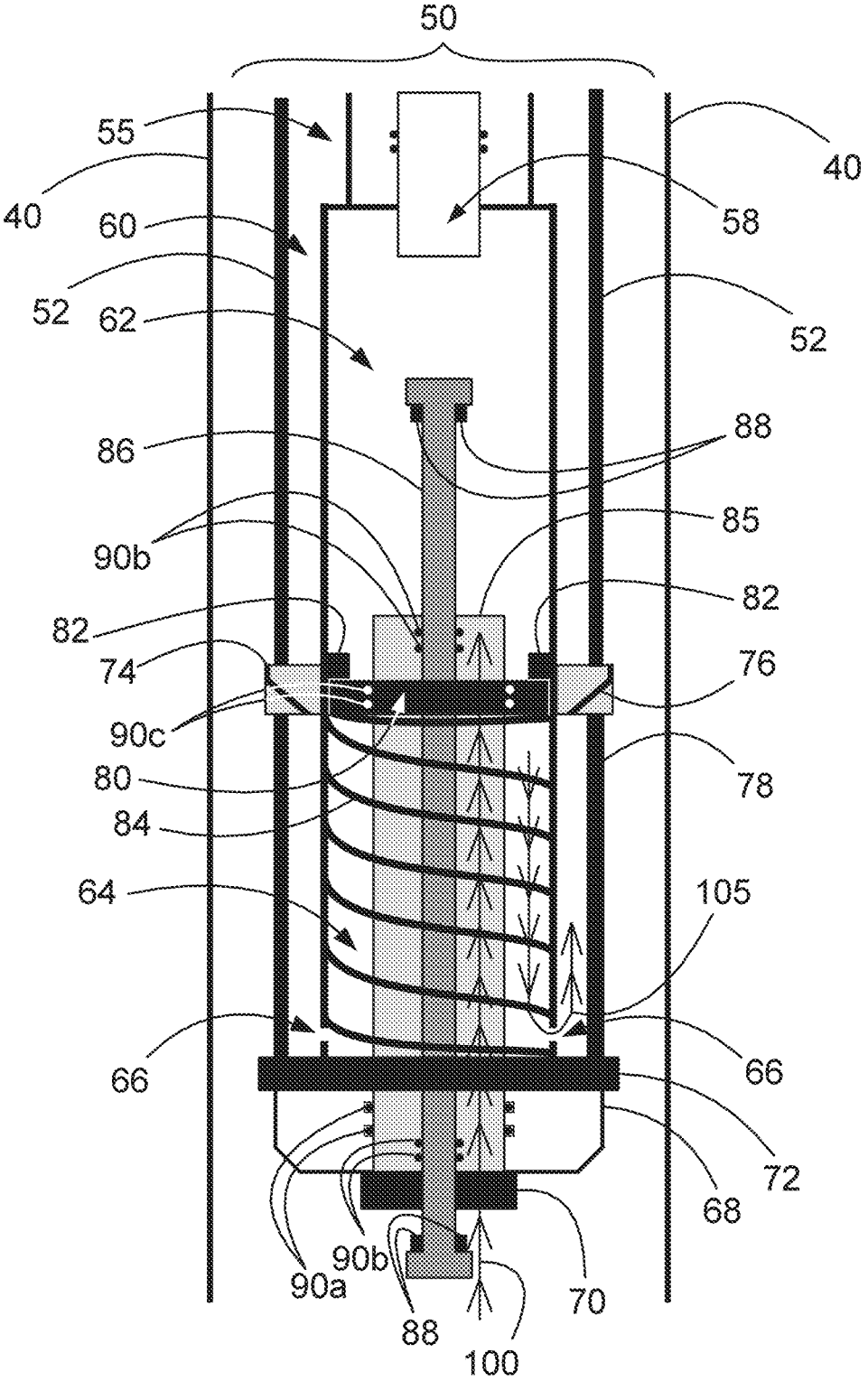
FIG. 2 is a close-up cross-sectional longitudinal view of a wireline pressure-testing tool according to another embodiment of the present disclosure, deployed into a production casing.

FIG. 2 shows an example of a downhole pressure-testing tool 50 according to another embodiment of the present disclosure, shown deployed into a production casing 40. This pressure-testing tool 50 comprises a chassis 52 within which are mounted a motor 55 operationally engaged with a pump 60 by an internal annulus 58 that is fitted with temperature and pressure sensors. The pump 60 has an upper chamber 62 and a lower chamber 64 defined by a piston retainer shoulder 82 circumferentially extending inward into the chambers 62, 64. A spring 84 biases a first piston 80 upwardly against the piston retainer shoulder 82. A bottom sub housing 68 is secured to the bottom of the pump 60 by a retainer nut 70. One or more ports 66 extend through the pump 60 housing near its bottom end. A cylinder 85 with a second piston 86 is housed within the cylinder 85. O-rings 90*a* are provided at the juncture between the bottom sub housing 68 and the cylinder 85, and O-rings 90*b* are provided between the cylinder 85 and the second piston 86 to make these junctures leak-proof. The second piston 86 has plunger shoulders 88 extending radially outward near its top end and bottom end designed to balance pressure between the sealing packing 78 and pressure below the pressure-testing tool 50. A radially expanding sealing packing 78 extends around the outer circumference of the pump 60 housing and is securely fixed to a lower portion of the pump 60 with a gauge ring 72, and is securely fixed to a lower portion of the motor 55 with a gauge ring 74 that cooperates with a spring-retractable hydraulic slip 76.

The deployment and use of the pressure-testing tool 50 is controlled from a wireline service truck using standard control devices, instruments, and monitors generally following the methods disclosed herein. The gauge rings 72 and 74 protect the pressure-testing tool 50 from physical damage as it is lowered into the production casing 40 to a selected position. After the pressure-testing tool 50 is in position, the spring-retractable hydraulic slip 76 is deployed outward by the first piston 80 to radially expand the sealing packing 78 against the inner circumference of the production casing 40, by forcing the flow of fluid from the lower chamber 64 of the pump 60 through ports 66 (shown by the line with arrows 105). The motor 55 provides the mechanical force through the annulus 58 to pressurize the fluid in the upper chamber 62 that forces the first piston 80 down against the spring 84. After the pressure delivered to the upper chamber 62 from the motor 55 has forced the first piston 80 to sealingly engage the sealing packing 78 with the production casing 40, increasing the pressure delivered to the upper chamber 62 by the motor 55 will then force the second piston 86 to exert pressure into the production casing space between the pressure-testing tool 50 and a bridge plug or alternatively, a cement plug, or alternatively, a cement retainer, until a target pressure level has been reached, for example 7000 kPa. Then, the motor 55 and pump 60 are turned off, and the pressure and temperature readings from a set of detectors extending from and below the pressure-testing tool 50 and from a set of detectors positioned above the pressure testing tool 50 are monitored and recorded for at least 10 minutes to determine if any changes in pressure occur within the space between the pressure-testing tool 50 and the bridge plug or the cement plug or the cement retainer. If the pressure in the production casing between the pressure-testing tool 50 and the bridge plug or the cement plug or the cement retainer remains at the target pressure point for the duration of the testing interval, e.g., 10 min, then it is confirmed that production casing 40 has been completely and stably sealed. However, if the pressure drops below the target pressure point during the testing interval, then the conclusion must be that the production casing has not been adequately sealed and that the pressure-testing tool 50 or the bridge plug or the cement plug or the cement retainer has to be reset and then retested.

Figure 3:
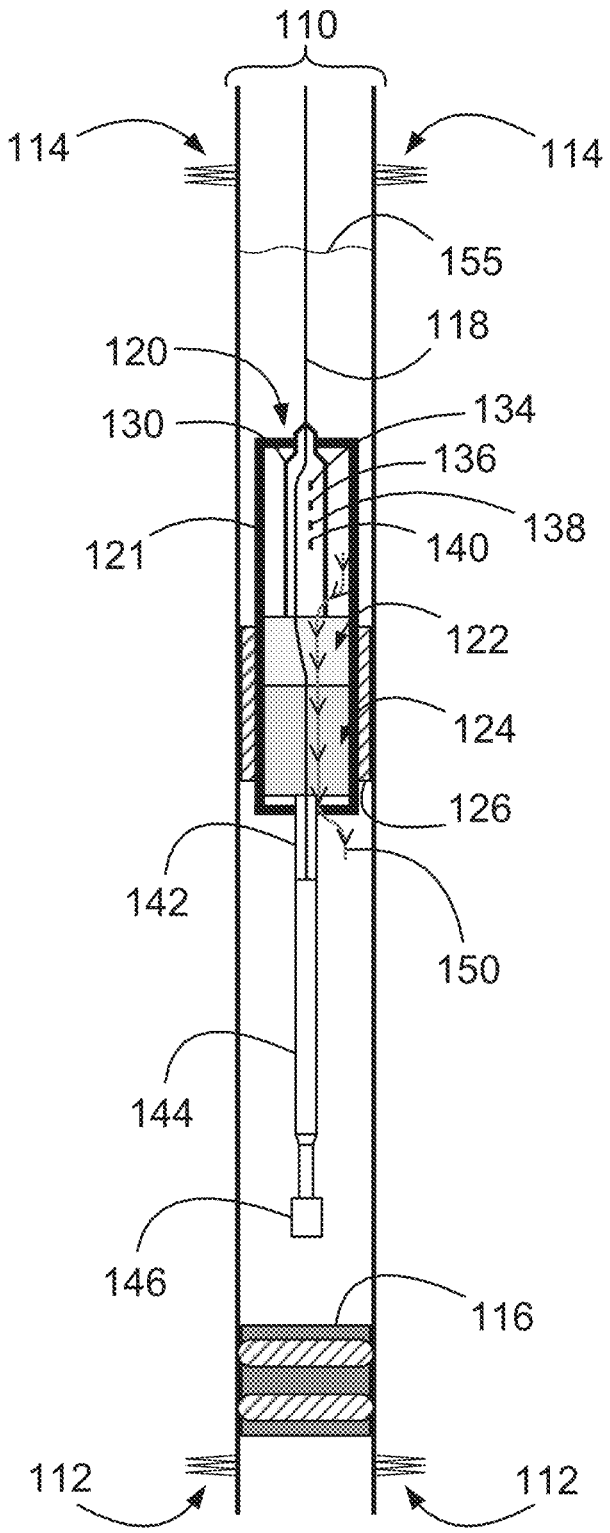
FIG. 3 is a schematic illustration of a wireline pressure-testing tool according to an embodiment of the present disclosure, deployed into a production casing above a permanent cement retainer.

FIG. 3 shows another example of a downhole pressure-testing tool 120 disclosed herein, deployed into a production casing 110 having a first set of perforations 112 communicating with a lower producing zone, and a second set of perforations 114 communicating with a producing zone closer to the surface. A bridge plug 116 has been installed and sealed into the production casing 110 just above the first set of perforations 112 and beneath the surface 155 of the fluid resident in the production casing 110. This pressure-testing tool 120 comprises a chassis 121 within which is engaged a motor 122 operationally engaged with a pump 124, and a radially expanding sealing packing 126 that has been sealingly engaged with the internal circumference of the production casing 110. The pressure-testing tool 120 is connected through a wireline cable head 130 to a wireline cable 118 deployed from a wireline service truck. The wireline cable head 130 connects to a number of sensors and instruments for example a casing collar locator 134, a gamma ray sensor/transducer 136, a first pressure sensor/transducer 138, and a first temperature sensor/transducer 140. Deployed below the pressure-testing tool 120 is a tubing 142 containing therein a second pressure sensor and a second temperature sensor. Tubing 142 is demountably engaged with an electric setting tool 144 which in turn, is demountably engaged with a plug setting sleeve adapter 146.

For use to install and pressure-test a bridge plug 116, as illustrated in FIG. 3, the pressure-testing tool 120 is engaged with an electric setting tool 144, or alternatively a hydraulic setting tool, which in turn is engaged with a plug-setting sleeve adapter 146. The bridge plug 116 is demountably engaged with the plug-setting sleeve adapter 146 after which the pressure testing tool 120 assembly with the bridge plug 116 attached, is deployed into the production casing 110 from a wireline service truck as generally disclosed in Examples 1 and 2 until a selected depth is reached based on correlation of recordings from the casing collar locator 134 and the gamma ray sensor/transducer 136 with gamma ray data recorded during previous downhole operations, whereby the bridge plug 116 is precisely positioned above a set of perforations e.g., perforations 112 as shown in FIG. 3. The bridge plug 116 is then set and sealed into place by remote control manipulation from the wireline service truck, of the setting tool 144 and the plug-setting sleeve adapter 146. After the bridge plug 116 has been set and sealed, the plug-setting sleeve adapter 146 is disengaged from the bridge plug 116 and the pressure-testing tool 120 is partially recovered to a selected position and distance above bridge plug 116. The pressure-testing tool 120 is then set and sealed into position within the production casing 110 generally following the description provided in the discussion pertaining to FIG. 2, by deploying radially expanding sealing packing 126 and then the slips (not shown). Then, the motor 122 and pump 124 cooperate to pump fluid from above the pressure-testing tool 120 into the space between the pressure-testing tool 120 and the bridge plug 116 (following the path with arrows shown as 150) until a target pressure is reached, for example 7000 kPa. Then, the motor 122 and pump 124 are turned off, and the pressure and temperature readings from the second pressure sensor and the second temperature sensor within the pressurized zone along with the pressure and temperature readings from the first pressure sensor and the first temperature sensor above the pressure-testing tool 120 are monitored for at least 10 minutes to determine if any changes in pressure occur within the space between the pressure-testing tool 120 and the bridge plug 116. If the pressure in the production casing 110 between the pressure-testing tool 120 and the bridge plug 116 remains at the target pressure point for the duration of the testing interval, e.g., 10 min, then it is confirmed that production casing 110 has completely and stably sealed. However, if the pressure within the pressurized zone of the production casing 110 drops below the target pressure point during the testing interval, then the conclusion must be that the or pressure-testing tool 120 or the production casing 110 has not been adequately sealed and that the bridge plug 116 has to be reset and retested.

It is to be noted that the downhole pressure-testing tools disclosed herein may be configured to deliver and maintain pressures in zones between the pressure-testing tools and bridge plugs or cement plugs or cement retainers being tested for the integrity of their seals, in the range of 4000 kPa, 5000 kPa, 6000 kPa, 7000 kPa, 8000 kPa, 9000 kPa, 10000 kPa, 11000 kPa, 15000 kPa, 20000 kPa, 25000 kPa, 30000 kPa, 35000 kPa, and therebetween.

Figure 4:
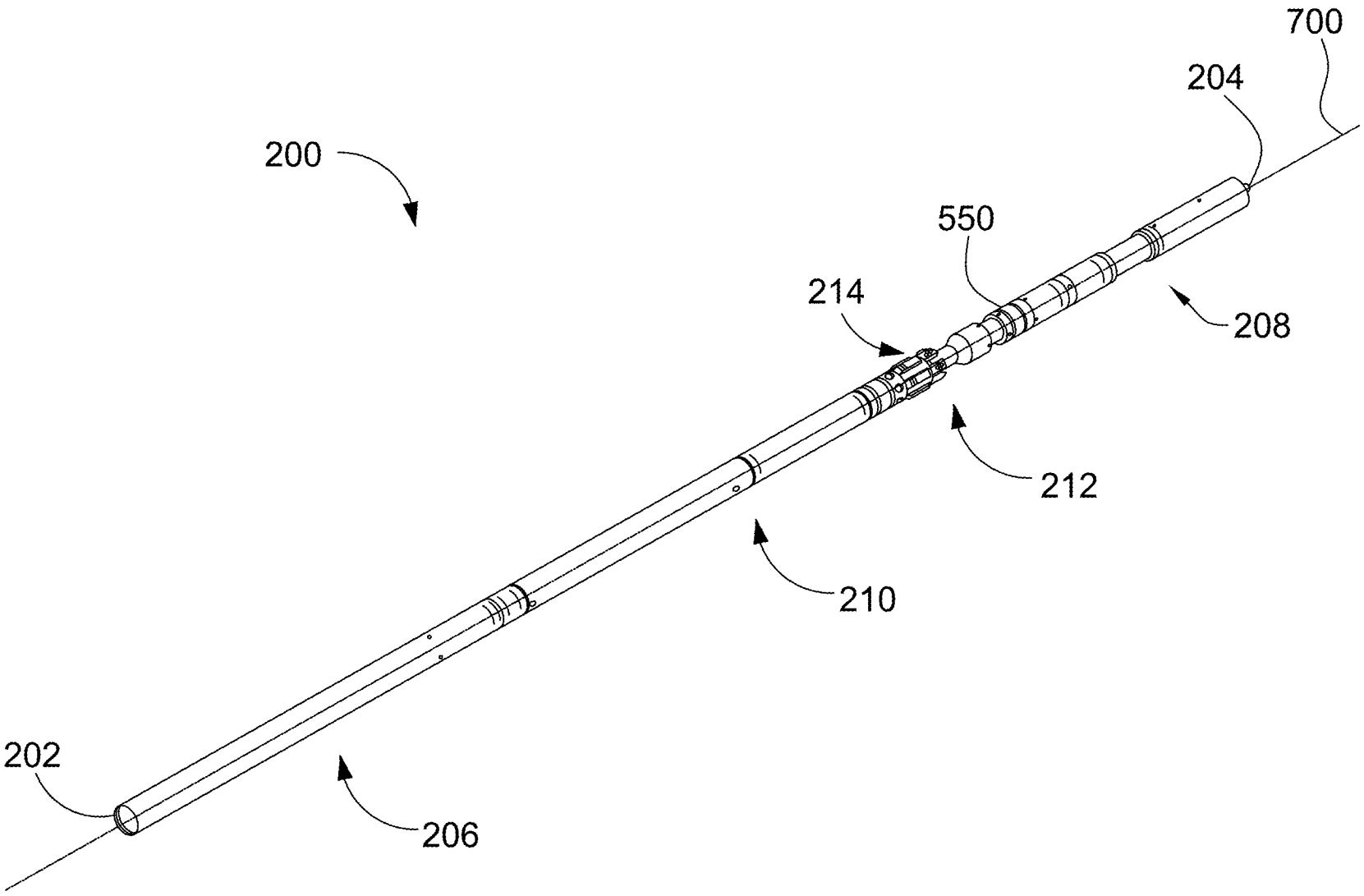
FIG. 4 is a perspective view of a wireline well abandonment tool according to a further embodiment of the invention.
Figure 5:
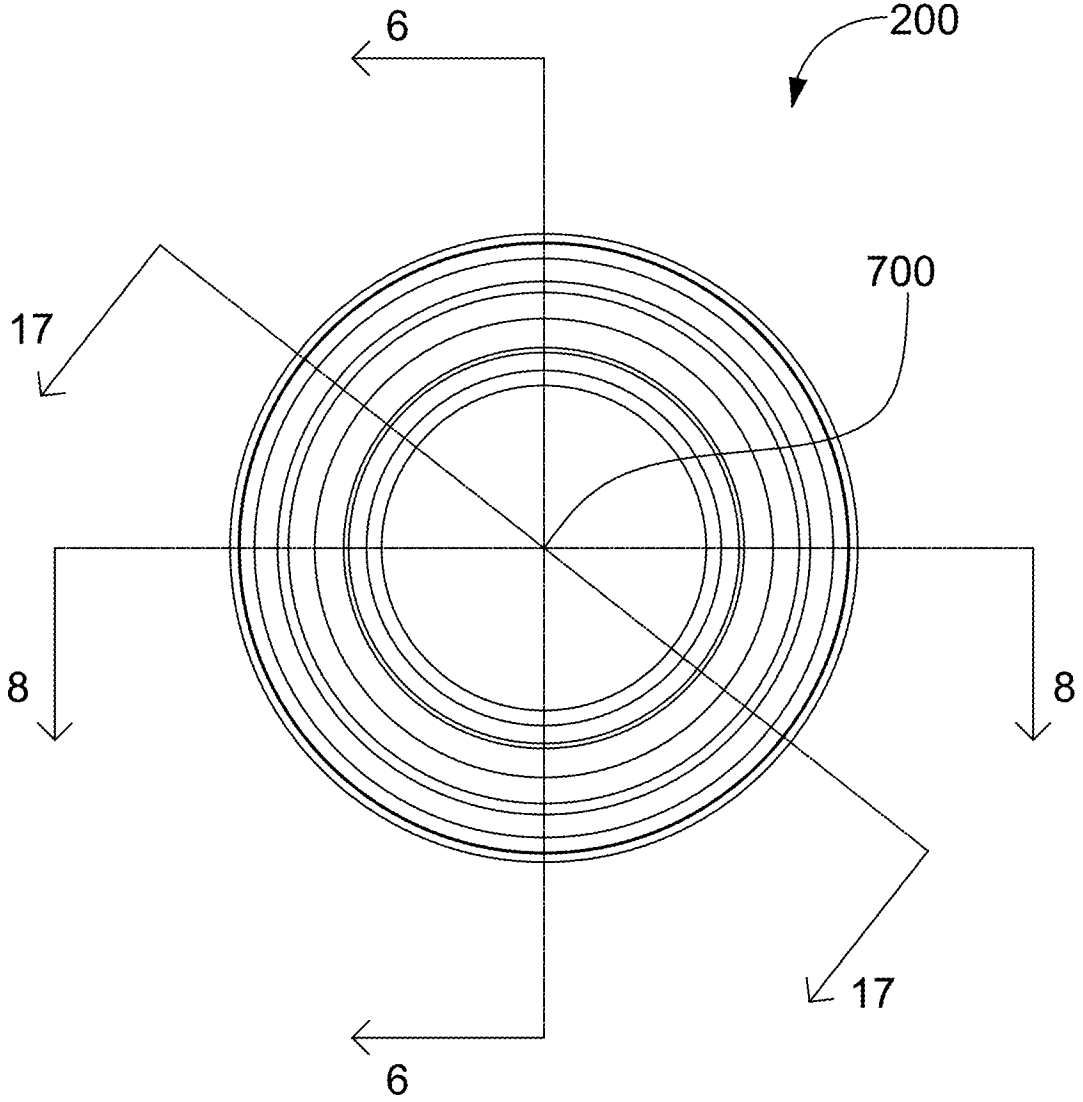
FIG. 5 is an end view of the wireline well abandonment tool of FIG. 4.
Figure 6:
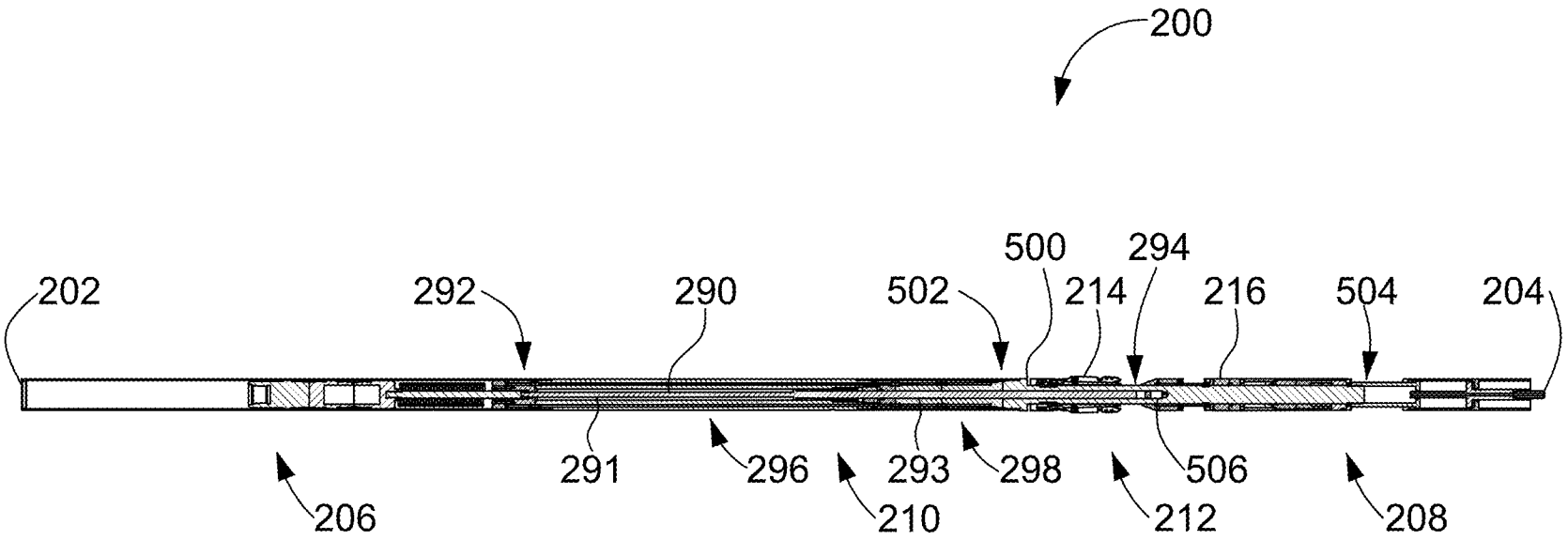
FIG. 6 is a side plane cross-sectional view of the wireline well abandonment tool taken along the line 6-6 of FIG. 5.

Referring to FIGS. 4 and 6, an apparatus to set and pressure test a bridge plug 16 in the production casing 10 of a subterranean well according to a further embodiment of the invention is shown generally at 200. The apparatus 200 comprises a substantially elongate cylindrical body and extends between first and second ends, 202 and 204, respectively, along a central axis 700. The apparatus 200 is comprised of a top connection section 206 proximate to the first end 202 and a bridge plug setting and testing section 208 proximate to the second end 204 with a fluid control section 210 and a retention section 212 therebetween. The retention section 212 utilizes mechanical force applied by the wireline 18 attached to the top connection section 206 to extend and retract a slip collet 214, as will be described in more detail below. The fluid control section 210 provides hydraulic pressure to expand a sealing element 550 in the retention section 212 and to set the bridge plug 16, attached to the bridge plug setting and testing section 208, then pressurizes a chamber therebetween for pressure testing, as will be further described below.

Figure 7:
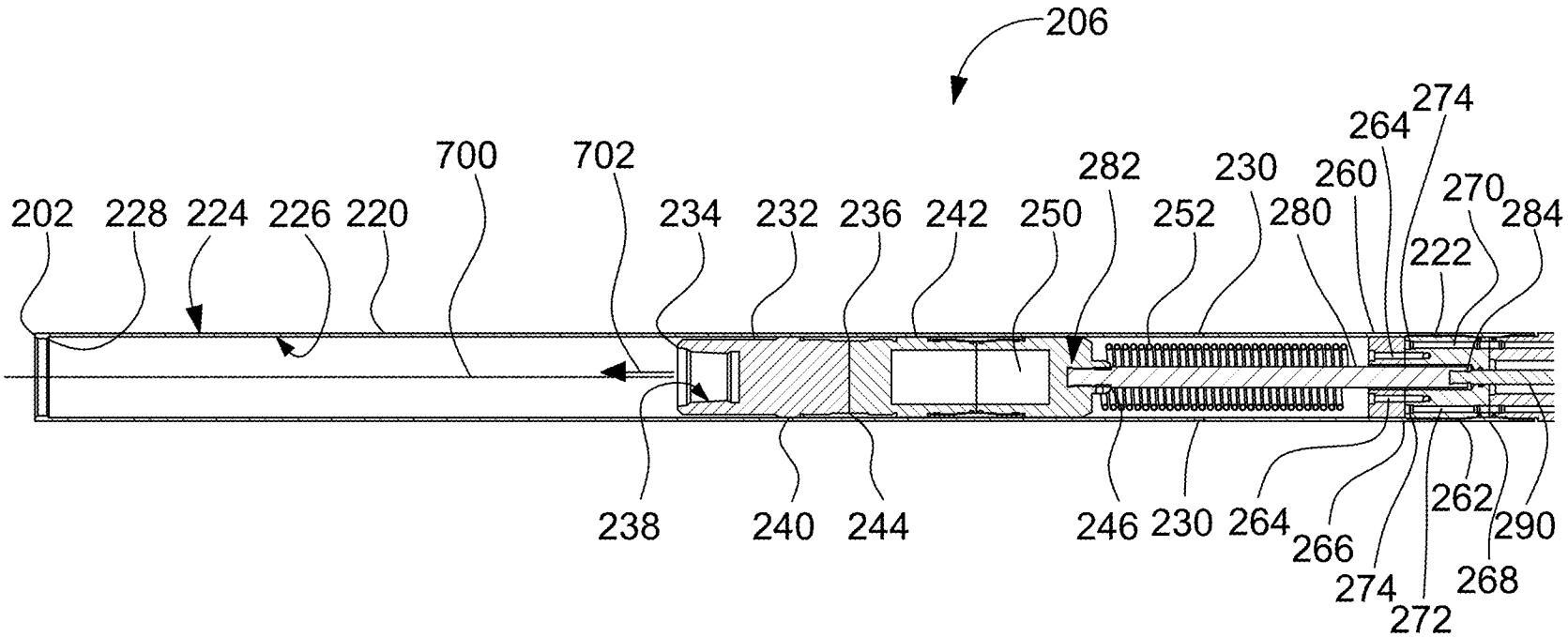
FIG. 7 is a side plane cross-sectional view of the top connection section taken along the line 6-6 of FIG. 5.
Figure 8:
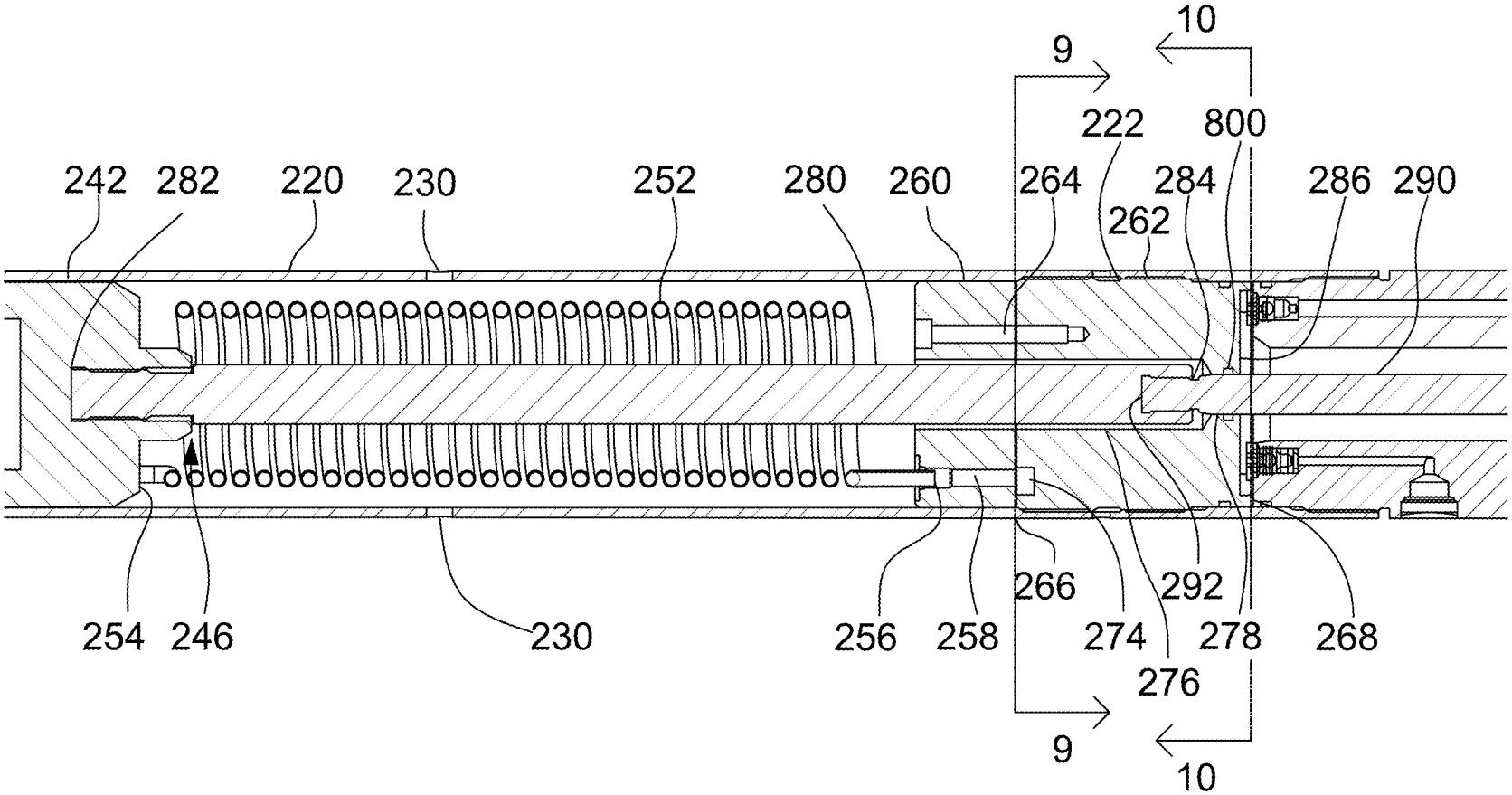
FIG. 8 is a detailed top plane cross-sectional view of the top connection section taken along the line 8-8 of FIG. 5.

Turning now to FIGS. 7 and 8, the top connection section 206 is contained within a top connection housing 220 which extends between the first end 202 and a second end 222. The top connection housing 220 has outer and inner surfaces 224 and 226, respectively, and includes an inner annular wall 228 which extends from the inner surface 226 proximate to the first end 202 in a direction towards the second end so as to retain the first end connector 232 as will be described below therein. A plurality of optional vent ports 230 may extend through the top connection housing 220 between the inner and outer surfaces 224 and 226, providing hydrostatic fluidic communication with the surrounding fluid in the production casing 10.

A first end connector 232 extends between first and second ends 234 and 236, respectively, and is connected to the wireline 18 by internal threading 238 at the first end 234, as is commonly known. When an upward force is applied to the first end connector 232 in the direction generally indicated at 702, the apparatus 200 is activated, as will be more fully explained below. The first end connector 232 includes an expanded portion 240 adapted to slideably engage with the inner surface 226 of the top connection housing 220.

An electronics housing 242 extends between first and second ends, 244 and 246, respectively, and is secured to the second end 236 of the first end connector 232 with a coupler 248, as is commonly known. The electronics housing 242 may be formed of a plurality of parts, as is commonly known, and contains an electronic control system 250 therein, controlled by signals received through the wireline 18. The electronics control system 250 is connected with wires through an electronics coil tube 252 to two solenoid valves, as will be set out below, and to a plurality of logging tools, such as, by way of non-limiting example, pressure sensors, temperature sensors and a marker fluid sensor. As best seen in FIG. 8, the electronics coil tube 252 extends between first and second ends, 254 and 256, respectively, and extends into the electronics housing 242 at the first end 254. The wires exit the electronics coil tube 252 at the second end 256 where they pass through a fluidically sealed electronics passage 258 in a top cap 260. The annular top cap 260 is secured to an annular upper housing 262 within the top connection housing 220 proximate to the second end 222 with threaded fasteners, as are commonly known, through a plurality of threaded fastener passages 264. The upper housing 262 extends between first and second ends, 266 and 268, respectively, and is secured within the second end 222 of the top connection housing 220 with external threading or the like, as is commonly known.

Figure 9:
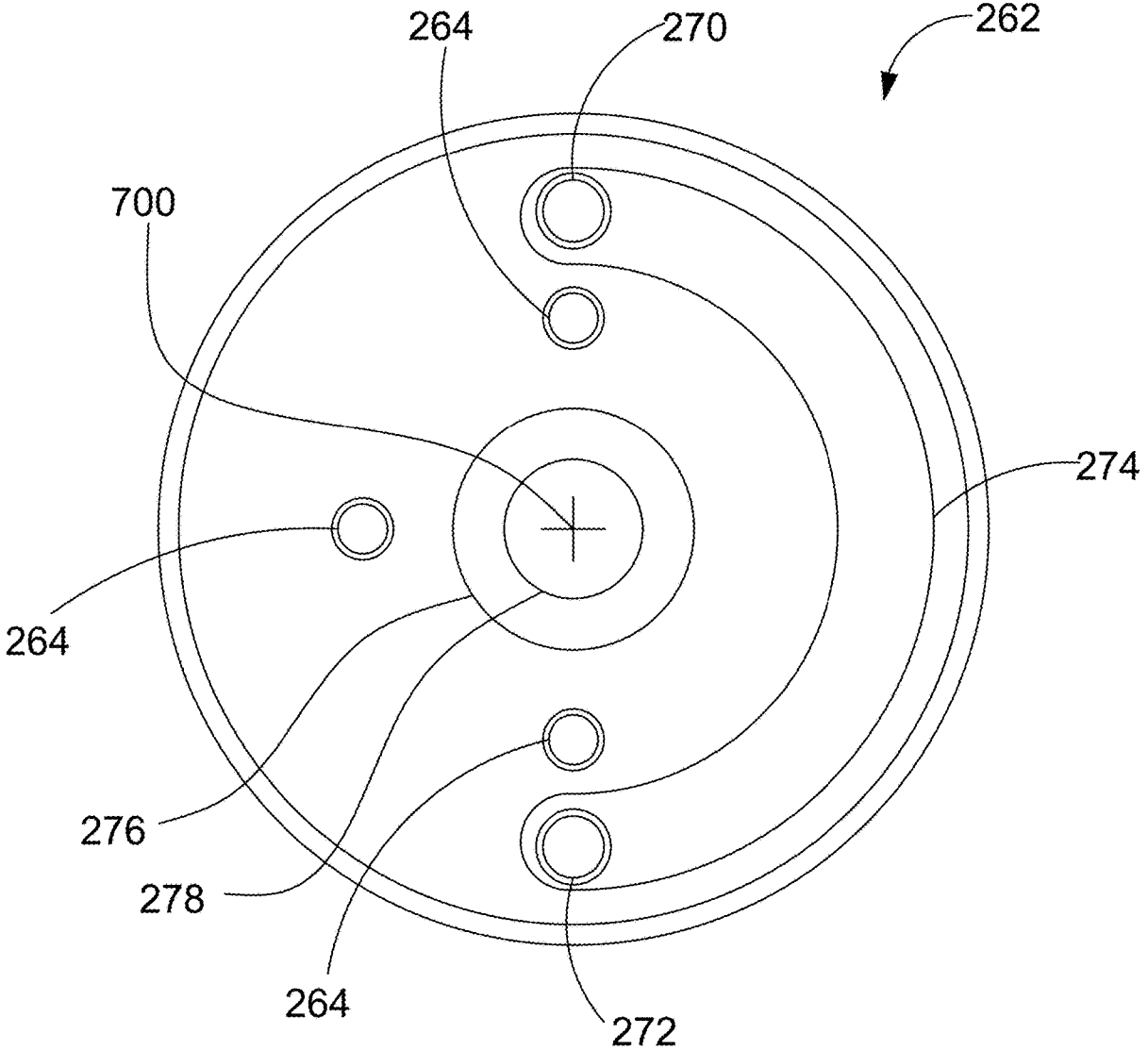
FIG. 9 is an end view of the upper housing, as viewed along the line 9-9 of FIG. 8.

Referring now to FIGS. 7 and 9, the upper housing 262 includes first and second valve electronics passages 270 and 272, respectively, extending axially therethrough. The first and second valve electronics passages 270 and 272 intersect an electronics C-channel 274. As seen on FIG. 8, the electronics passage 258 through the top cap 260 is aligned with the electronics C-channel 274 such that the wires passing through the electronics passage 258 may be directed to pass through the electronics C-channel 274 and into the first and second valve electronics passages 270 and 272. The first and second valve electronics passages 270 and 272 are connected to first and second valves, as will be set out in more detail below.

Turning back to FIGS. 7 and 8, a pump top rod 280 extends between first and second ends, 282 and 284, respectively, and is secured to the electronics housing 242 at the first end 282 and passes through a central pump rod passage 276 in the top cap 260 and upper housing 262. A pump mandrel 290 extends between first and second ends 292 and 294, respectively, as best illustrated in FIG. 6, and is secured to the second end 284 of the pump top rod 280 at the first end 292 by means as are commonly known. As illustrated, the pump mandrel 290 includes a smaller radius first stage portion 291 extending from the first end 292 and a larger radius second stage portion 293 extending from the second end 294. As best shown in FIG. 8, the central pump rod passage 276 includes a narrowed portion 278. The pump mandrel 290 is adapted to sealably pass through the narrowed portion 278 with a pump seal 800 therebetween. The pump seal 800 separates the hydrostatic fluid in the top connection section 206 from the pressurized fluid in the fluid control section 210, as will be described in more detail below.

Figure 10:
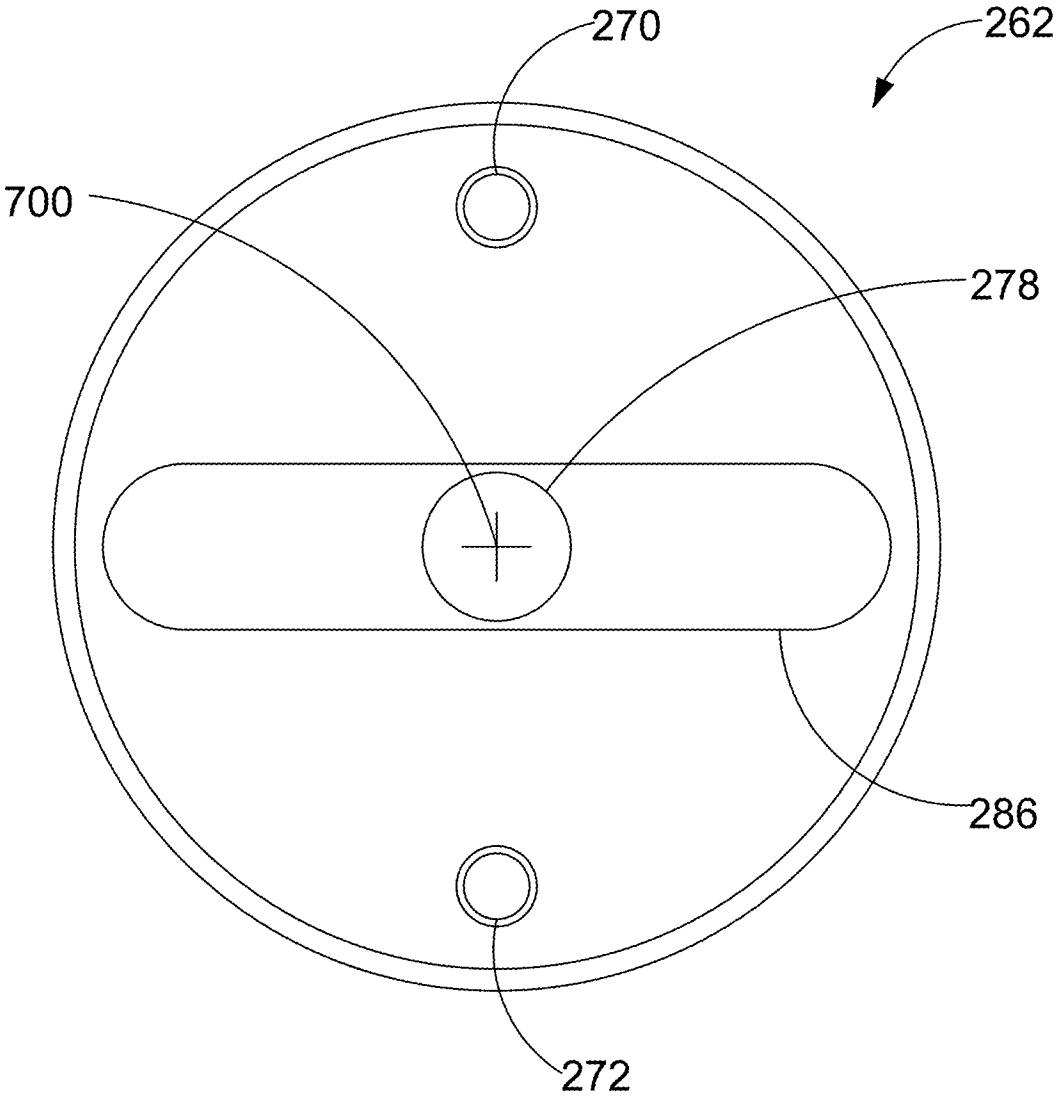
FIG. 10 is an end view of the upper housing, as viewed along the line 10-10 of FIG. 8.

Turning now to FIGS. 8 and 10, the second end 268 of the upper housing 262 includes a recessed channel 286 therein. As outlined above, the first and second valve electronics passages 270 and 272 pass through the upper housing 262, and are not connected with the recessed channel 286. The pump mandrel 290 passes through the recessed channel 286. The purpose of the recessed channel 286 will be set out in more detail below.

Turning back to FIG. 6, the fluid control section 210 includes a two-stage piston pump 296 and valves 298. The pump 296 creates hydraulic pressure to pressurize and move fluid through the apparatus 200 while the valves 298 control the fluid flow direction and therefore the function of the apparatus 200, as will be set out in more detail below.

Figure 11:
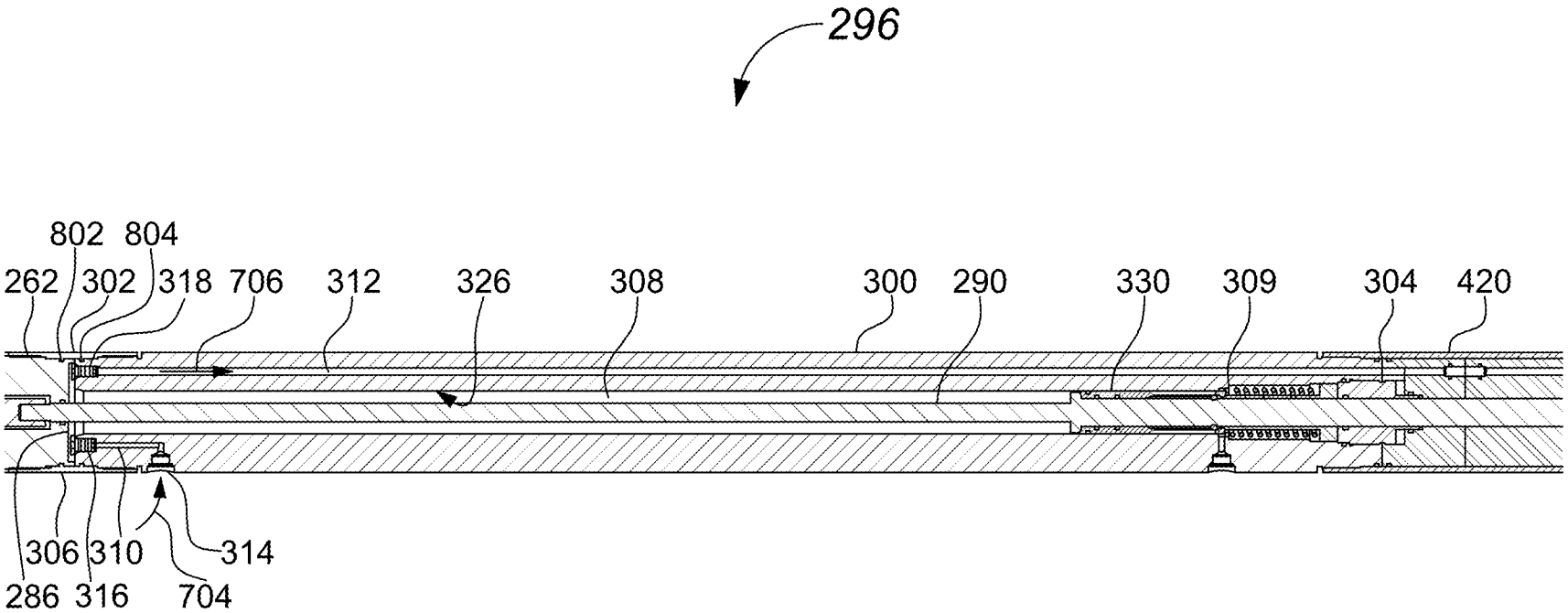
FIG. 11 is a top plane cross-sectional view of the pump taken along the line 8-8 of FIG. 5.
Figure 12:
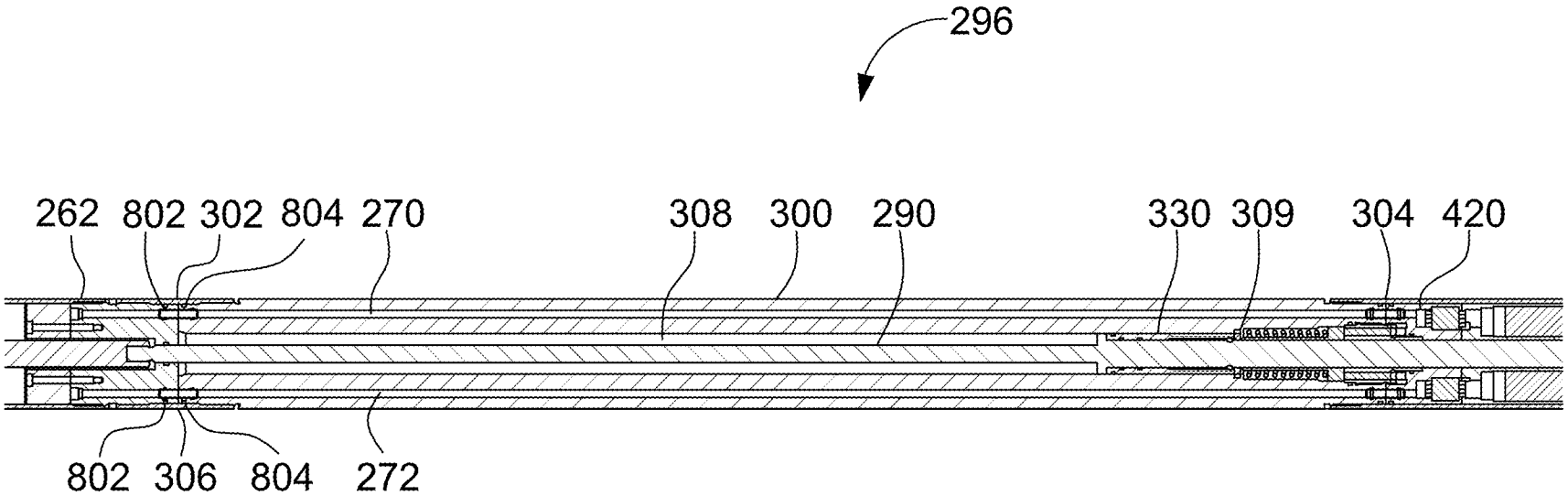
FIG. 12 is a side plane cross-sectional view of the pump taken along the line 6-6 of FIG. 5.

Referring to FIGS. 11 and 12, the pump 296 is contained within a pump housing 300 with the pump mandrel 290 passing therethrough along the central axis 700. A releasable collar 330 is selectably attached to the pump mandrel 290 to switch between low and high-pressure pumping operation, as will be set out in more detail below.

The pump housing 300 extends between first and second ends 302 and 304, respectively, and is sealably secured to the upper housing 262 at the first end 302 with a threaded housing coupler 306, as is commonly known, with seals 802 and 804 therebetween. As illustrated in FIG. 12, the first and second valve electronics passages 270 and 272 pass through the pump housing 300, extending from the upper housing 262, as set out above, and extend into a motor housing routing sleeve 420, which will be further outlined below.

As best illustrated in FIG. 11, the pump mandrel 290 passes through a central pump cavity 308, which extends between the first end 302 of the pump housing 300 and a second end 309 and has an inner surface 326. The central pump cavity 308 is fluidically connected by the recessed channel 286 at the first end 302 to a fluid intake passage 310 and a valve supply passage 312. The fluid intake passage 310 includes an intake filter or mesh 314 as are commonly known to remove contaminants as fluid is drawn therethrough from the surrounding fluid in the production casing 10. An intake check valve 316 within the fluid intake passage 310 allows fluid flow in one direction only, as generally indicated by 704 in FIG. 11. The valve supply passage 312 contains a valve supply check valve which allows fluid flow in one direction only, as generally indicated at 706.

Figure 13:
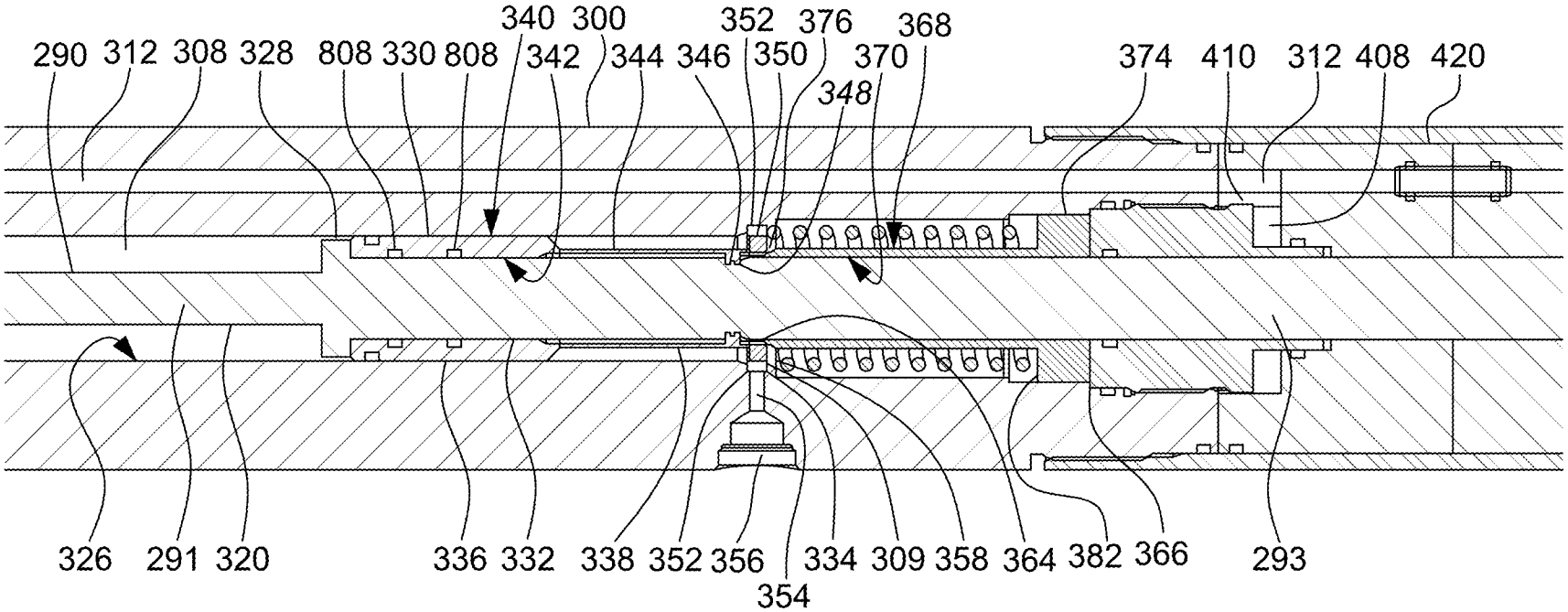
FIG. 13 is a detailed top plane cross-sectional view of the releasable pump collar taken along the line 8-8 of FIG. 5.
Figure 14:
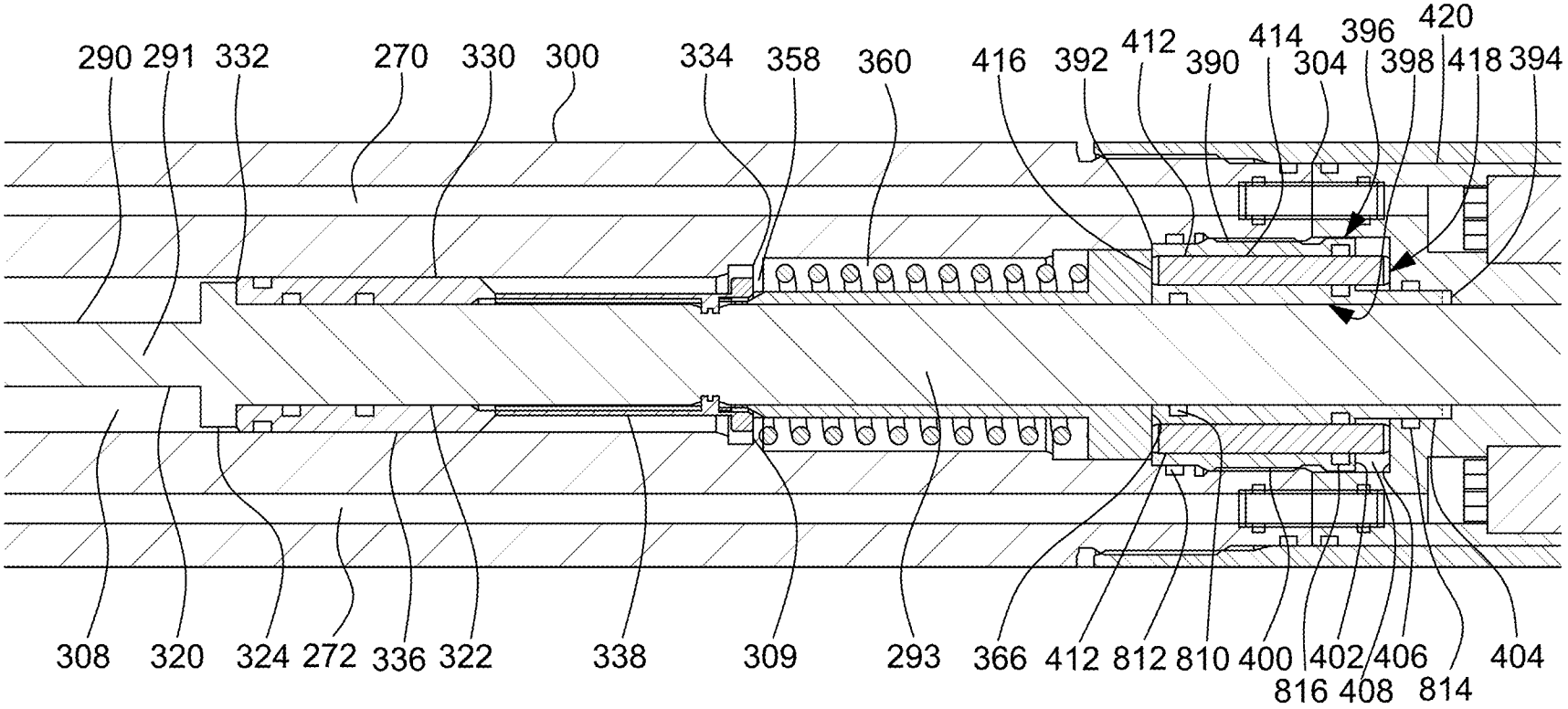
FIG. 14 is a detailed side plane cross-sectional view of the releasable pump collar taken along the line 6-6 of FIG. 5.

Referring now to FIGS. 13 and 14 for a detailed view and to FIG. 6 for a full-length reference view, the pump mandrel 290 is comprised of a first stage rod portion 320 extending from the first end 292 and a second stage rod portion 322 extending from the second end 294 with a wide portion 324 therebetween. The first stage rod portion has a smaller diameter than the second stage rod portion 322, the purpose of which will be set out below. In a first stage, low pressure pumping configuration, the releasable collar 330 is secured to the second stage rod portion 322 of the pump mandrel 290 proximate to the wide portion 324, as will be set out in more detail below.

The diameter of the wide portion 324 is selected to form an annular passage 328 between the wide portion 324 and the inner surface 326, allowing fluid to pass thereby. The releasable collar 330 extends between first and second ends 332 and 334, respectively, and has outer and inner surfaces 340 and 342, respectively, and is comprised of a sealing portion 336 extending from the first end 332 and a releasable finger portion 338 extending from the second end 334. The first end 332 of the releasable collar 330 engages upon the wide portion 324 of the pump mandrel 290. The outer surface 340 of the sealing portion 336 is adapted to engage with the inner surface 326 with an outer seal 806 therebetween. The inner surface 342 of the sealing portion 336 is adapted to engage upon the second stage rod portion 322 with inner seals 808 therebetween. The releasable finger portion 338 is comprised of a plurality of collet fingers 344. Each collet finger 344 includes a first stage inner locking ridge 346 extending from the inner surface 342 proximate to the second end 334 adapted to engage within an annular first stage locking groove 348 on the second stage rod portion 322. When the first stage inner locking ridges 346 are engaged within the first stage locking groove 348, as illustrated in FIGS. 13 and 14, the releasable collar 330 is secured to the pump mandrel 290. At the second end 334, each collet finger 344 includes a second stage outer locking block 350, adapted to pass through the central pump cavity 308 when in a first stage configuration, as illustrated in FIGS. 13 and 14. In a second stage high pressure pumping configuration, the second stage outer locking blocks 350 retain the releasable collar 330 at the second end 309, as will be set out in more detail below.

The central pump cavity 308 includes a second stage annular locking groove 352 in the inner surface 326 at the second end 309 adapted to engage the second stage locking blocks 350 therein for the second stage high pressure pumping configuration, as will be set out below. As seen in FIG. 13, a hydrostatic pump passage 354 with an intake filter 356 therein is fluidically connected to the second stage annular locking groove 352. As the pump mandrel 290 reciprocates within the central pump passage 308, as will be set out below, the hydrostatic pump passage 354 allows fluid from within the surrounding production casing 10 to enter and exit the pump passage 308 below the releasable collar 330.

The pump housing 300 includes an inner annular lip 358 at the second end 309 of the central pump cavity 308 separating the central pump cavity 308 from a second stage spring cavity 360. A pump unlock sleeve 362 extends between first and second ends 364 and 366, respectively, and has outer and inner surfaces, 368 and 370, respectively, and is adapted such that the inner surface 370 slideably engages upon the second stage rod portion 322 of the pump mandrel 290. The pump unlock sleeve 362 is comprised of a wedge portion 372 extending from the first end 364 to an annular wall 382 and a spring engagement portion 374 extending between the annular wall 382 and the second end 366. The wedge portion 372 includes a tapered tip 376 at the first end 364 and is adapted to pass between the inner annular lip 358 and the pump mandrel 290. As will be set out in more detail below, the wedge portion 372 with the tapered tip 376 is adapted to bias the collet fingers 344 such that the second stage outer locking block 350 engages within the second stage annular locking groove 352 and to release the first stage inner locking ridge 346 from the first stage locking groove 348.

The second stage spring cavity 360 includes a widened portion 378 defined by an annular wall 380. The spring engagement portion 374 of the pump unlock sleeve 362 is adapted such that the outer surface 368 slideably engages upon the widened portion 378 of the second stage spring cavity 360. A second stage spring 384 extends between the inner annular lip 358 and the annular wall 382 of the spring engagement portion 374 within the second stage spring cavity 360, the purpose of which will be set out further below.

As best seen on FIG. 14, a pump unlock pin sleeve 390 extends between first and second ends 392 and 394, respectively, and has outer and inner surfaces 396 and 398, respectively. The pump unlock pin sleeve 390 is secured within the pump housing 300 at the second end 304 by threading or the like and extends into the motor housing routing sleeve 420. The pump unlock pin sleeve 390 is adapted such that the inner surface 398 is slideably engaged with the pump mandrel 290 with an inner seal 810 therebetween. The pump unlock pin sleeve 390 is comprised of a pin housing portion 400 extending from the first end 392 to an annular wall 402 and a narrow portion 404 extending from the annular wall 402 to the second end 394. The outer surface 396 of the pin housing portion 400 is sealably engaged with the pump housing 300 at the first end 392 with an outer seal 812 therebetween. The outer surface 396 of the narrow portion 404 is sealably engaged with the motor housing routing sleeve 420 at the second end 394 with an outer seal 814 therebetween.

The motor housing routing sleeve 420 includes an annular wall 406 spaced apart from the annular wall 402, forming an annular pin control cavity 408 therebetween. Turning now to FIG. 13, a pin control passage 410 fluidically connects the valve supply passage 312 with the annular pin control cavity 408, the purpose of which will be set out below.

Turning back to FIG. 14, the pump unlock pin sleeve 390 includes at least one axial pin passage 412 therethrough, which extends between the first end 392 and the annular wall 402. A high-pressure pump pin 414 extends between first and second ends 416 and 418, respectively, and optionally has tapered ends as illustrated. A high-pressure pump pin 414 extends through each axial pin passage 412 with a pin seal 816 therebetween. The first end 416 of each high-pressure pump pin 414 is engaged upon the second end 366 of the pump unlock sleeve 362 and the second end 418 extends into the annular pin control cavity 408 and engages upon the annular wall 406 while in the first stage low-pressure pumping configuration. The purpose of the high-pressure pump pins will be set out in more detail below.

Figure 15:
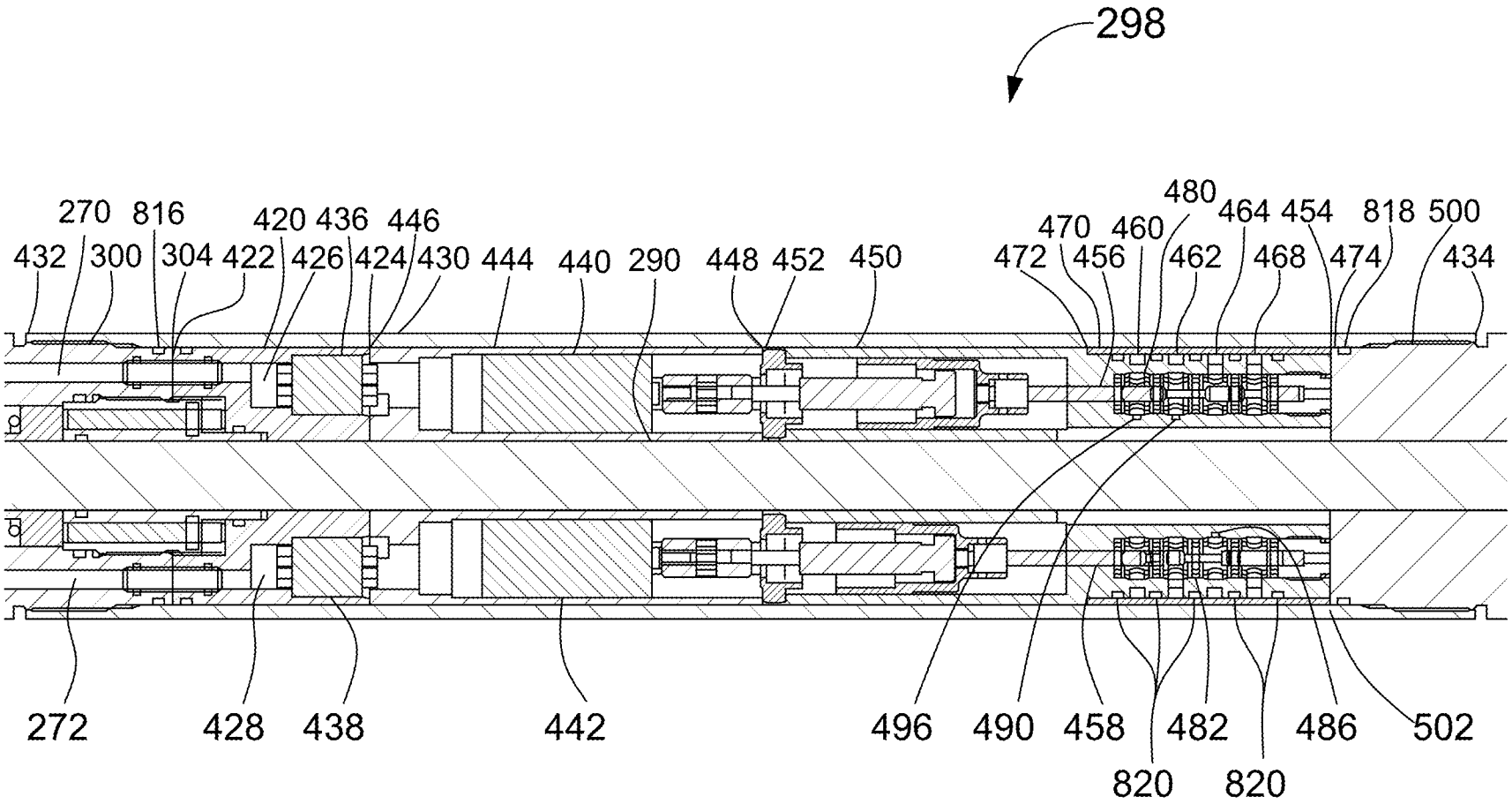
FIG. 15 is a side plane cross-sectional view of the valve taken along the line 6-6 of FIG. 5.
Figure 16:
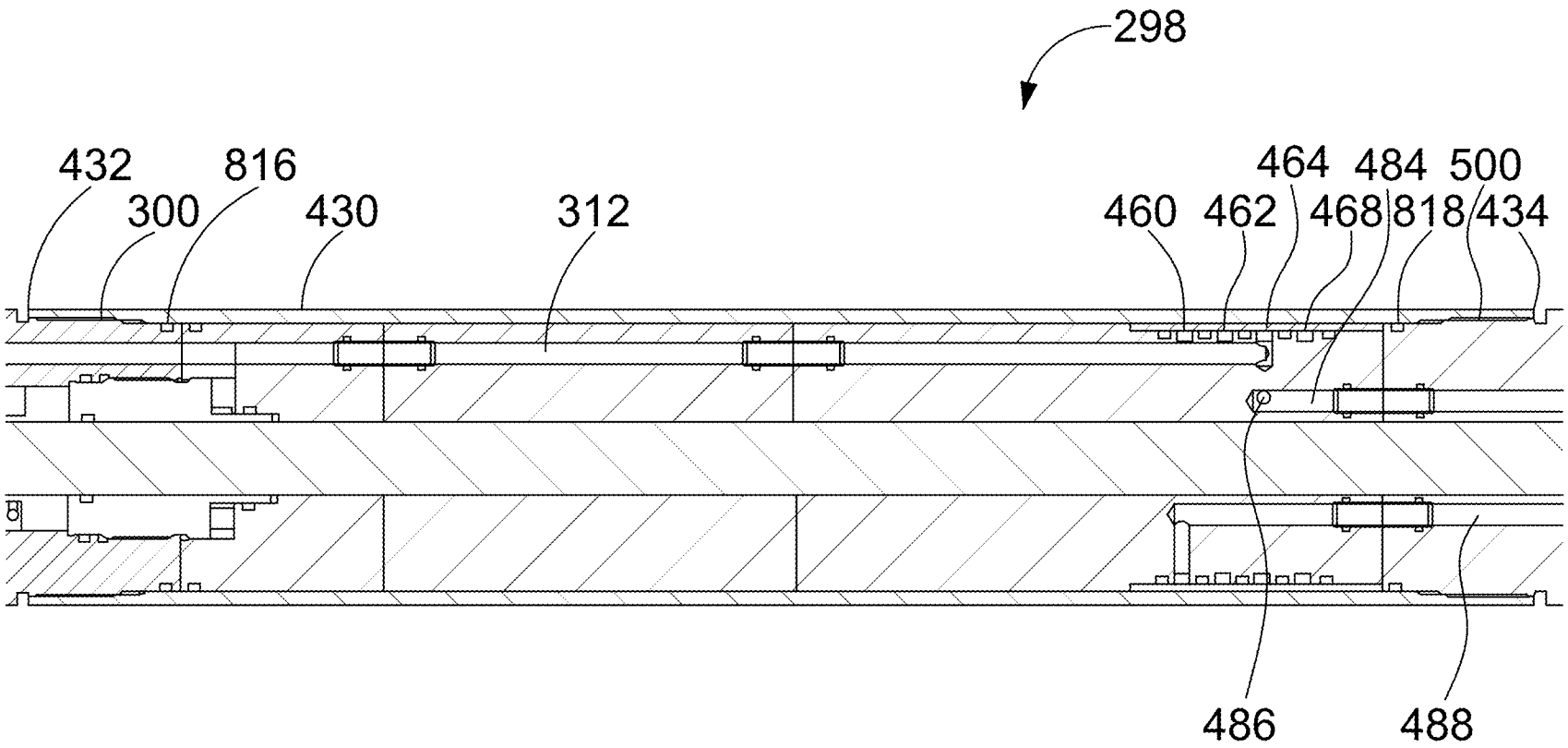
FIG. 16 is a top plane cross-sectional view of the valve taken along the line 8-8 of FIG. 5.
Figure 17:
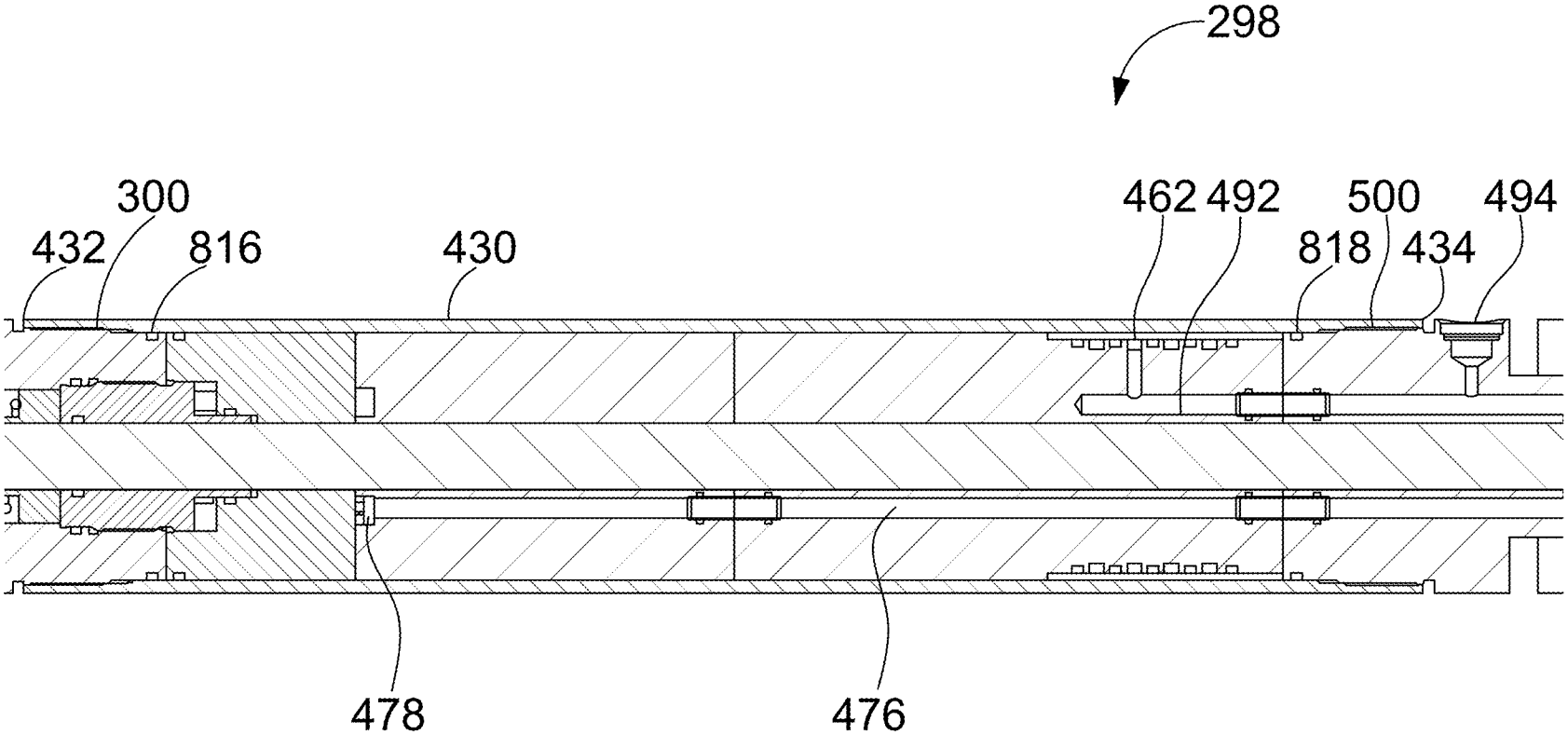
FIG. 17 is a diagonal plane cross-sectional view of the valve taken along the line 17-17 of FIG. 5.

Turning now to FIGS. 15, 16 and 17, the valves 298 are retained within a valve outer housing 430 which extends between first and second ends 432 and 434, respectively. The valve outer housing 430 is secured to the pump housing 300 at the first end 432 with threading or the like with a seal 816 therebetween and to a main mandrel 500 at the second end 434 with threading or the like with a seal 818 therebetween.

Referring now to FIG. 15, the motor housing routing sleeve 420 extends between first and second ends 422 and 424, respectively, and engages upon the second end 304 of the pump housing 300 with the first and second valve electronics passages 270 and 272 extending therethrough into first and second valve connector cavities 426 and 428, respectively. The first and second valve connector cavities 426 and 428 contain therein first and second electric connectors 436 and 438, respectively. The electronics from the electronic control system 250 pass through the first and second valve electronics passages 270 and 272 into the first and second valve connector cavities 426 and 428 and connect to the first and second electric connectors 436 and 438, respectively, as is commonly known.

First and second electric motors 440 and 442, respectively, are contained within a motor housing 444, which extends between first and second ends 446 and 448, respectively. The first and second electric connectors 436 and 438 are connected to the first and second electric motors 440 and 442, respectively, as is commonly known, proximate to the second end 424. A valve housing 450 extends between first and second ends 452 and 454, respectively, and contains first and second valve manifold rods 456 and 458, respectively therein within first and second valve cavities 480 and 482, respectively. The valve housing 450 is aligned such that the first end 452 engages upon the second end 448 of the motor housing 444. The first and second electric motors 440 and 442 control the positions of the first and second valve manifold rods 456 and 458 with valve trains, as is commonly known.

The valve housing 450 includes first, second, third and fourth annular valve passages, 460, 462, 464 and 466, respectively, therearound proximate to the second end 454. A valve sleeve 470 extends between first and second ends 472 and 474, respectively and is adapted to sealably enclose and sealably separate the annular valve passages 460, 462, 464 and 466 with a plurality of valve seals 820 therebetween. The first, second and fourth annular valve passages, 460, 462 and 466, respectively, are fluidically connected to the second valve cavity 482 while the third and fourth annular valve passages, 464 and 466, respectively, are fluidically connected to the first valve cavity 480. The valve manifold rods 456 and 458 are controlled by the first and second electric motors 440 and 442 to adjust the fluidic connections between the annular valve passages, as will be set out in more detail below.

Turning now to FIG. 16, the valve supply passage 312 extends from the pump housing 300 and is fluidically connected to the third annular valve passage 464 and into the first valve cavity 480. A first pressurizing passage 484 is fluidically connected to the second valve cavity 482 through a valve connection passage 486, as seen on FIGS. 15 and 16, and extends into the bridge plug setting and testing section 208, as will be described more fully below. A second pressurizing passage 488 is fluidically connected to the first annular valve passage 460 and into the second valve cavity 182. The second pressurizing passage 488 is fluidically connected to the first valve cavity 480 through a valve connection passage 490, as seen on FIG. 15.

Turning now to FIG. 17, a hydrostatic passage 492 is fluidically connected to the second annular valve passage 462, which is connected to the second valve cavity 482. The hydrostatic passage is fluidically connected to the surrounding hydrostatic fluid in the production casing 20 through a filter 494. The hydrostatic valve passage 492 is also fluidically connected to the first valve cavity 480 through a valve connection passage 496, as seen on FIG. 15. An electronics passage 476 extends from a connecting passage 478 in the motor housing 444 and extends into the main mandrel 500. The connecting passage 478 fluidically connects to the first valve connector cavity 426 allowing for electrical connections to pass therethrough and extend into the electronics passage 476, the purpose of which will be set out below.

Figure 18:
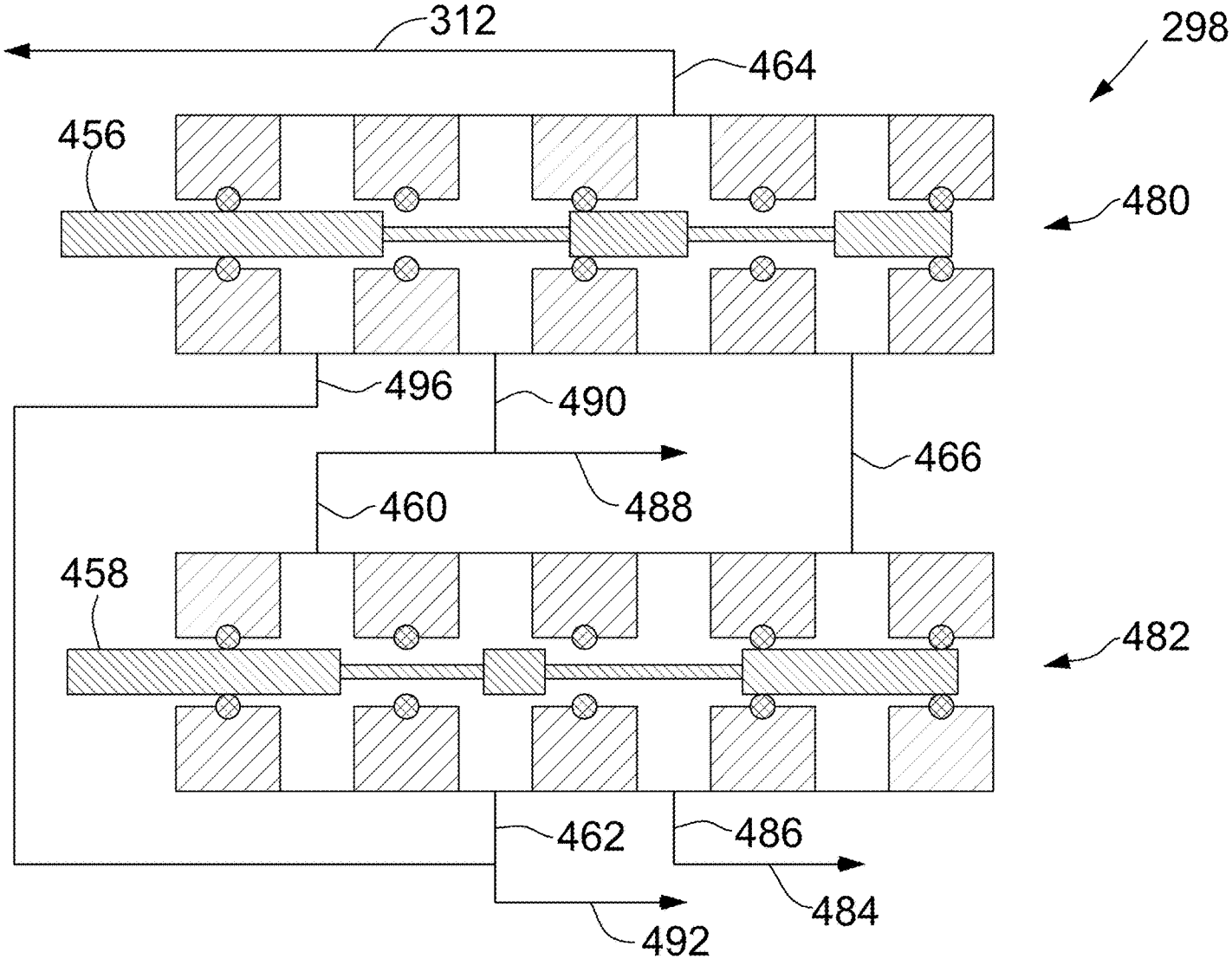
FIG. 18 is a schematic of the valve in a first or placement position.

Turning now to FIGS. 18 through 21, the first and second valve cavities 480 and 482 are illustrated schematically with the first and second valve manifold rods 456 and 458, respectively, therein and the passages described connected thereto. In FIG. 18 the valves 298 are illustrated in a first or placement position. In this position, pressurized fluid from the valve supply passage 312 enters the first valve cavity 480 but is blocked from entering the second valve cavity 482. The first and second pressurizing passages 484 and 488 are fluidically connected with the hydrostatic passage 492 through the second valve cavity 482.

Figure 19:
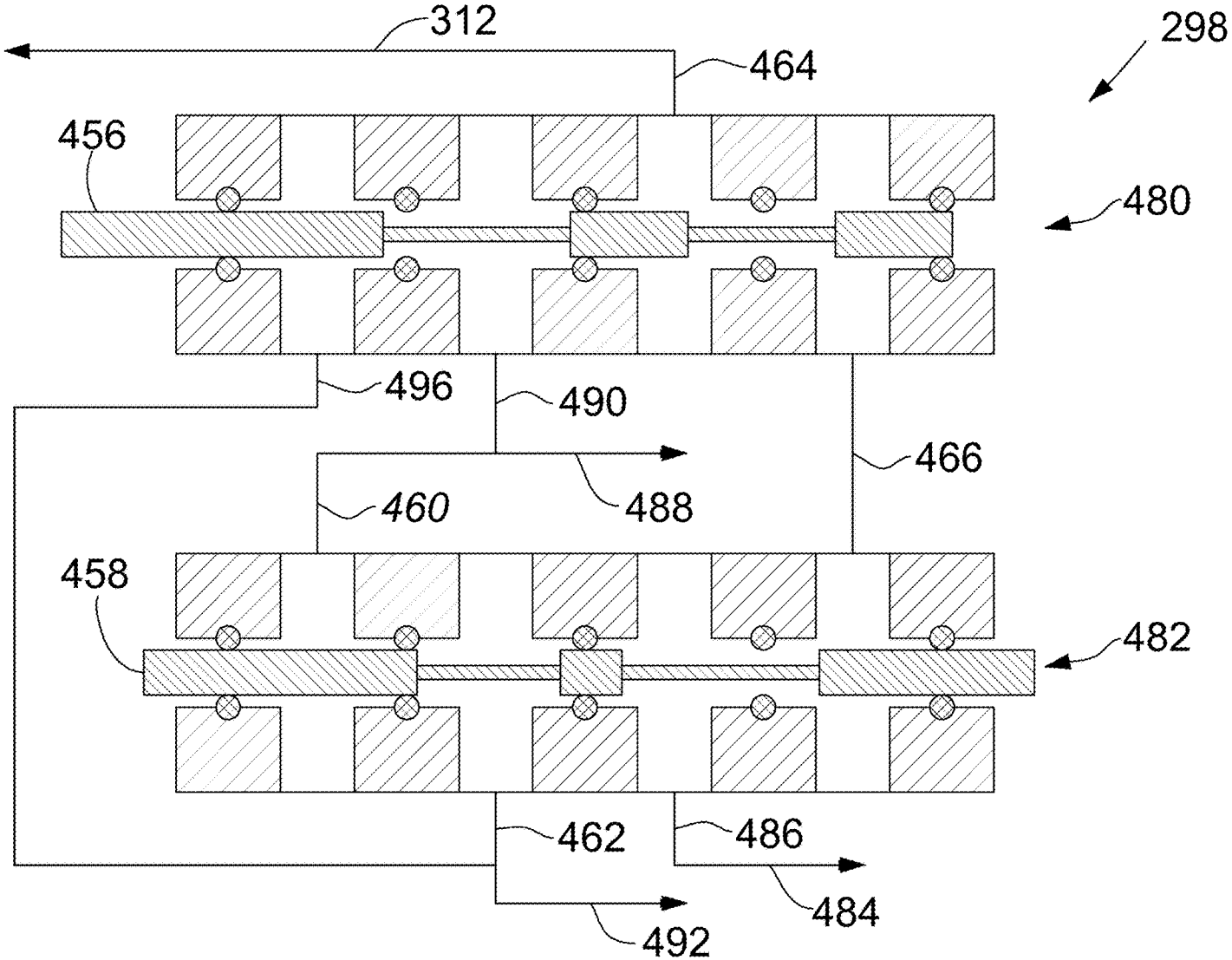
FIG. 19 is a schematic of the valve in a second or sealing element set position.

FIG. 19 illustrates a second or element set position. In this position, pressurized fluid from the valve supply passage 312 enters the first valve cavity 480 and is fluidically connected to the second valve cavity 482 through the fourth annular valve passage 466. The pressurized fluid is fluidically connected to the first pressurizing passage 484 through the second valve cavity 482. The second pressurizing passage 488 is fluidically connected to the hydrostatic passage 492 through the first valve cavity 480.

Figure 20:
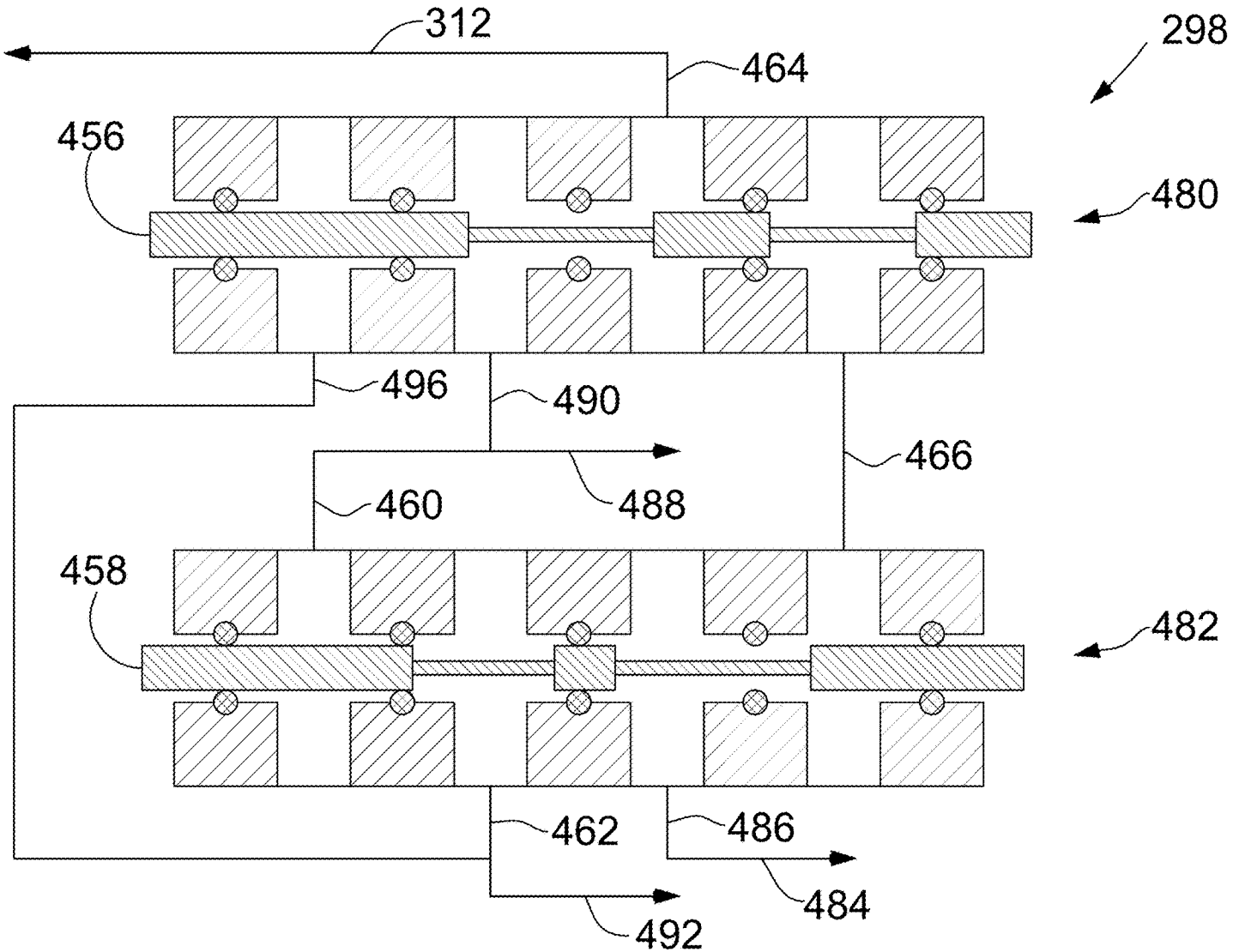
FIG. 20 is a schematic of the valve in a third or pressurizing position.

A third or pressurizing position is illustrated in FIG. 20. In this position, pressurized fluid from the valve supply passage 312 enters the first valve cavity 480 and is fluidically connected to second pressurizing passage 488. The first pressurizing passage 484 is isolated and maintains its pressure. The hydrostatic passage 492 is also isolated in this position.

Figure 21:
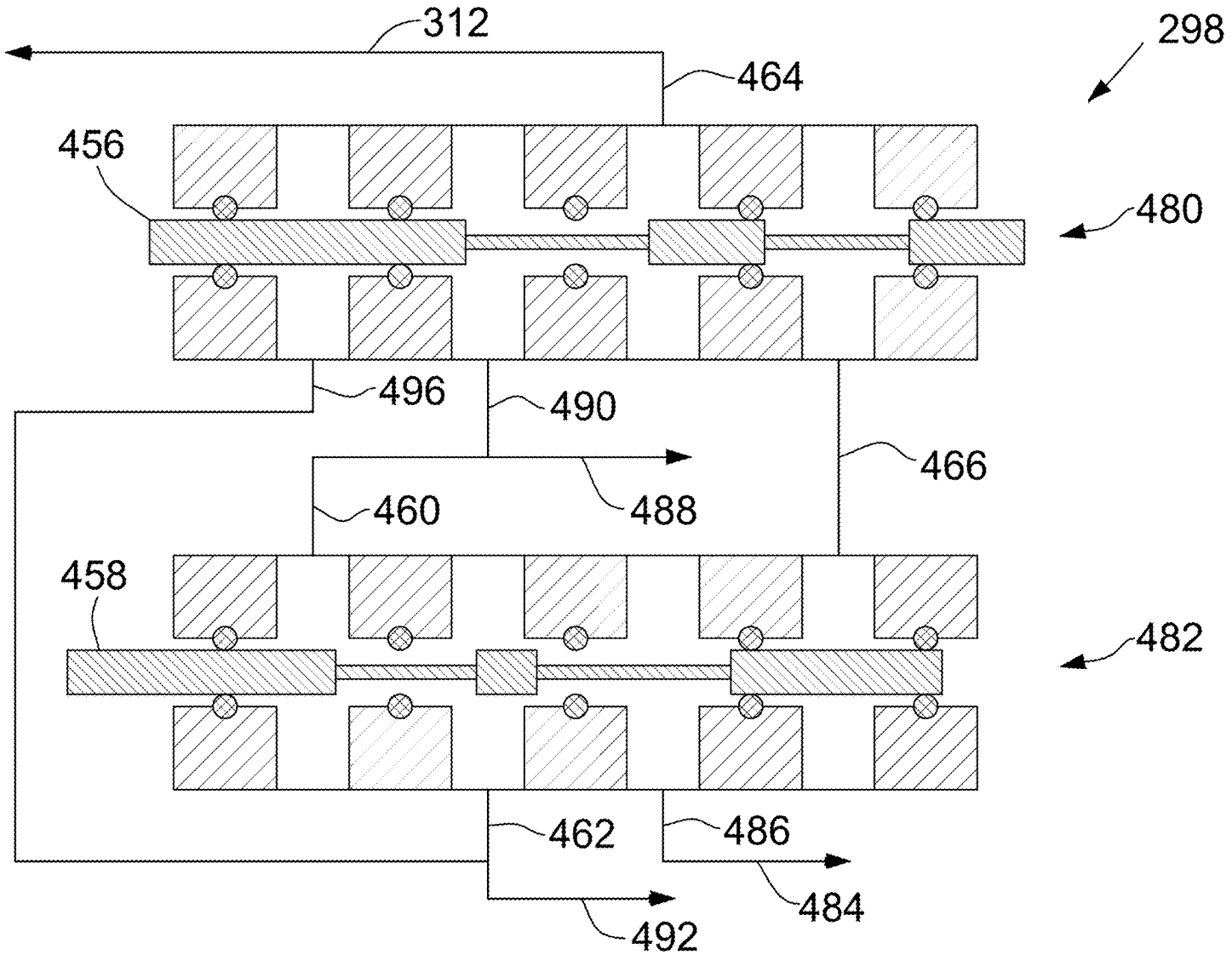
FIG. 21 is a schematic of the valve in a fourth or release position.

FIG. 21 illustrates the fourth or release position for the valves 298. In this position, pressurized fluid from the valve supply passage 312 enters the first valve cavity 480 and is fluidically connected to the second valve cavity 482 through the valve connection passage 490 and the first annular valve passage 460. The first and second pressurizing passages 484 and 488 are also fluidically connected to the second valve cavity 482. The second valve cavity 482 is fluidically connected to the hydrostatic passage 492, therefore in this position, all pressurized fluid is released from the apparatus 200 through the hydrostatic passage 492.

Referring back to FIG. 6, the retention section 212 includes a slip collet 214 on a main mandrel 500. The main mandrel 500 extends between first and second ends 502 and 504, respectively, and includes a central axial cavity 506 adapted to slideably retain the second end 294 of the pump mandrel 290 therein. As illustrated in FIG. 15, the first end 502 of the main mandrel 500 engages upon the second end 454 of the valve housing 450 and is retained within the valve outer housing 430 at the second end 434 with a seal 818 therebetween. As illustrated in FIG. 16, the first and second pressurizing passages 484 and 488 extend into the main mandrel 500, as will be set out further below. As illustrated in FIG. 17, the hydrostatic passage 492 extends into the main mandrel 500 and is fluidically connected to the surrounding fluid in the production casing 200 through the filter 494. The electronics passage 476 also extends into the main mandrel 500.

Figure 22:
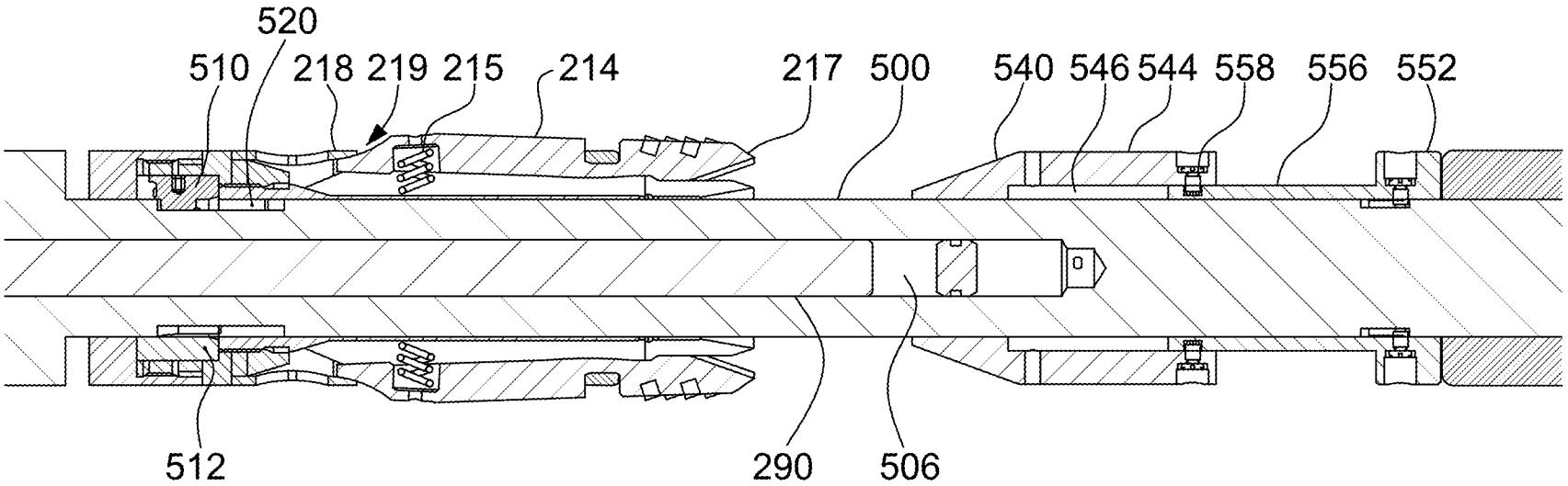
FIG. 22 is a side plane cross-sectional view of the slip collet and cone taken along the line 6-6 of FIG. 5.
Figure 32:
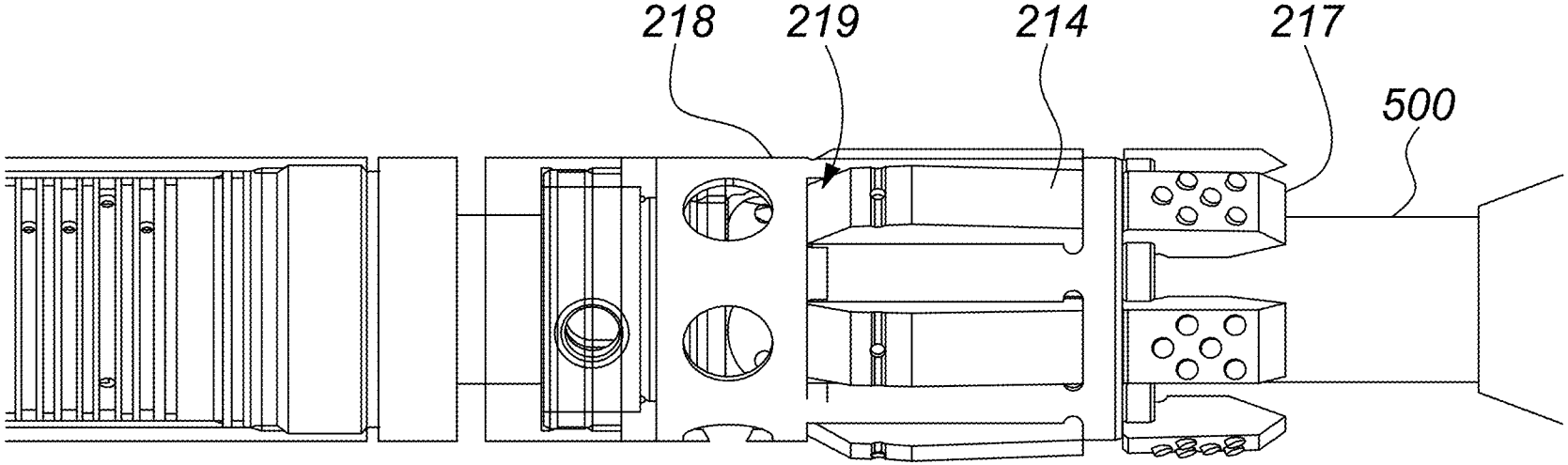
FIG. 32 is a detailed side view of the collet arms and collet cage of the apparatus of FIG. 5.

As illustrated in FIG. 22, the slip collets 214 includes a plurality of axial drag collet arms 216 secured within and retained by a collet cage 218. As illustrated in FIG. 32 the collet cage 218 includes a plurality of longitudinally extending openings 219 sized to receive the collet arms 216 therethrough. The collet arms extend to a distal gripping portion 217 and may include a one or more grip enhancement such as a hardened steel stud or plug extending therefrom as is commonly known. The collet cage 218 is may be formed of on or more components and includes a plurality of collet pins 510 extending therefrom into engagement with a J-slot 520 in the main mandrel 500 as set out below. A spring 215 may be located under an end distal to the gripping portion 217 so as to bias such top end against the wellbore 18 thereby providing a starting drag force for the collet arms and J-slots.

The main mandrel 500 extends through the collet cage 2018 and plurality of collet arms 214 as illustrated in FIG. 22 as well as a collet extension cone 540. As will be described in more detail below, the collet cage 218 with the collet arms 214 attached thereto, shifts axially over the main mandrel 500 such that the collet arms 214 engage upon the cone 540, extending the collet arms 214 such that the apparatus 200 may be fixed in place within the wellbore 10 as will be more fully described below.

Figure 23:
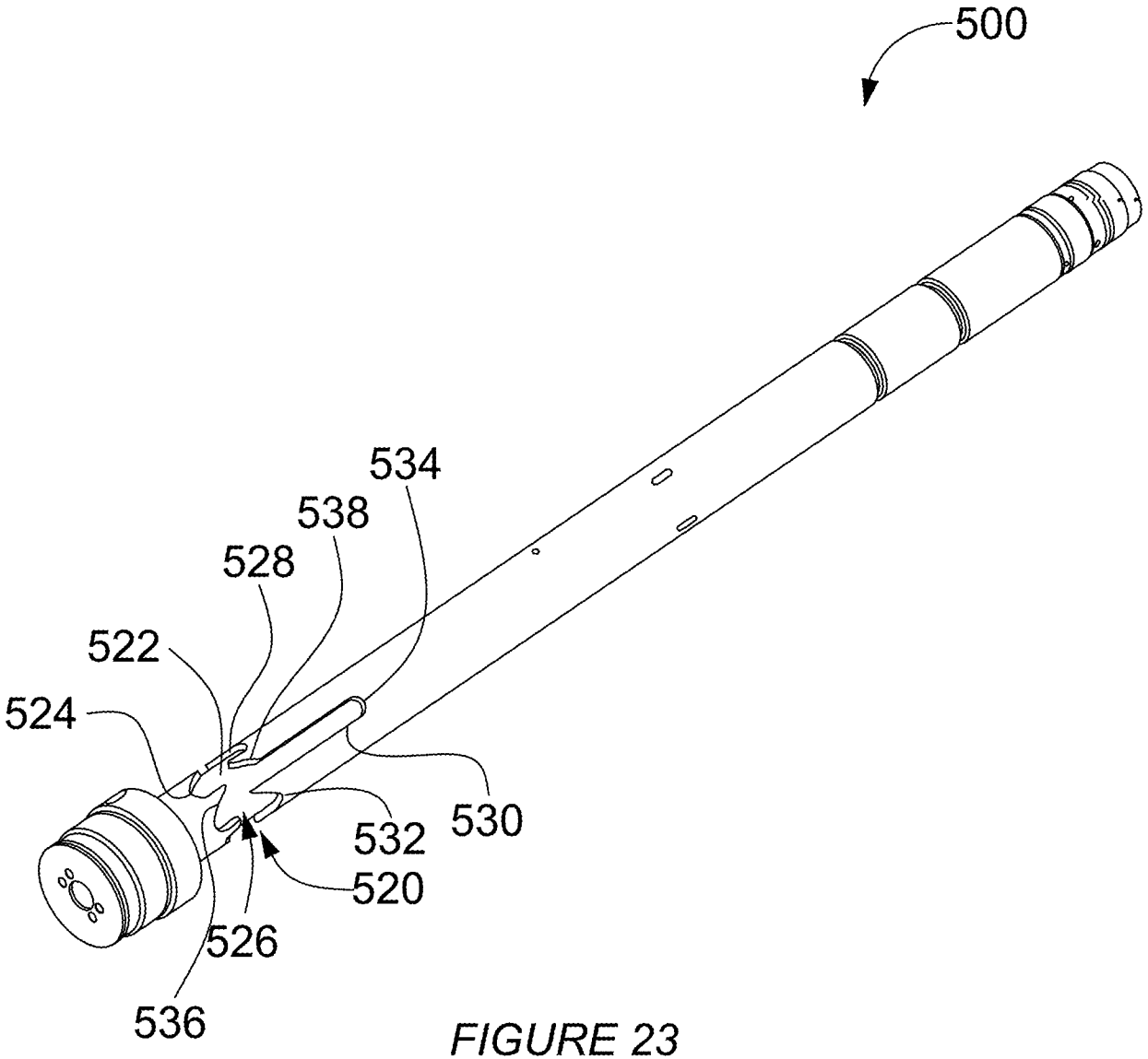
FIG. 23 is a perspective view of the main mandrel.

Turning now to FIG. 23, a perspective view of the main mandrel 500 is illustrated. The main mandrel 500 includes a plurality of axial J-slots 520 thereon, distributed evenly therearound. The J-slots are formed of upper and lower portions to permit the collet cage and arms to be selectably axially displaced along the main mandrel and into engagement with the cone 540. In particular, the J-slots 520 include a plurality of lower J-slots 522 extend between lower slot first ends 524 and a slot cross-over 526. In the present embodiment of the invention, six lower J-slots 522 are evenly distributed around the main mandrel 500 although it will be appreciated that more or less may also be utilized. The upper J-slots are axially offset from the lower J-slots 522 and alternate between short upper J-slots 528 and long lower J-slots 530. In the present embodiment of the invention, three short upper J-slots 528 alternate with three long upper J-slots 530. The short upper J-slots 528 extend between the slot cross-over 526 and the short upper J-slot second end 532. The long upper J-slots 530 extend between the slot cross-over 526 and the long upper J-slot second end 534. The lower J-slots 524 are axially offset from the upper J-slots 528 and 530 such that each upper J-slot, 528 or 530, is positioned axially between a pair of lower J-slots 522. As illustrated, the lower J-slots 522 have angled upper slot ends 536 and the upper J-slots 528 and 530 have angled lower slot ends 538 at the slot cross-over 526. Angled upper and lower slot ends, 536 and 538, respectively, are angled in opposite directions, the purpose of which will be set out below.

With reference back to FIG. 22, the collet cage 218 may include a plurality of collet pins 510 extending therefrom to be received within the J-slot 520. In particular, a plurality of collet pins 510 may be evenly spaced around the main mandrel 500 so as to correspond to the number of long or short upper J-slots 528 or 530 so as to ensure that all collet pins 510 are be located within either long or short upper J-slot. The collet pins 510 may be positioned within the collet cage 218 by a collet pin bushing 512 retained within an annular groove in the collet cage 218 with clearance fits so as to permit rotation of the collet pin busing about the collet cage 218 and main mandrel 500.

Figure 24:
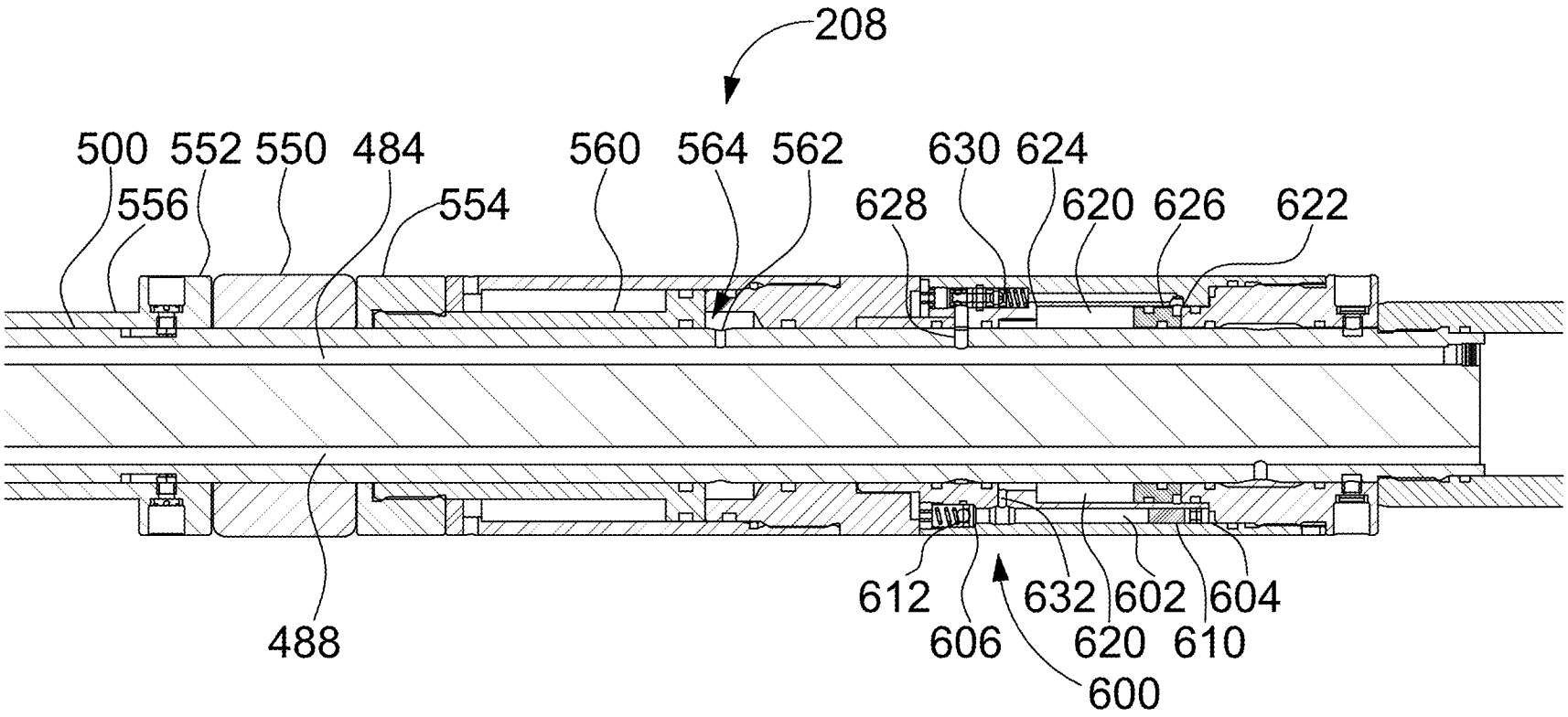
FIG. 24 is a top plane cross-sectional view of the sealing element and fluid test chamber taken along the line 8-8 of FIG. 5.

With reference to FIGS. 22 and 24, the cone 540 is slidably locatable along the main mandrel 500 and includes a frustoconical collet engagement surface 542 at a top end thereof and an outer cylindrical extension 544 extending towards a bottom end thereof. The cylindrical extension 544 is spaced apart from the main mandrel 500 so as to form an annular cavity 546 therebetween. A seal as is commonly known 550 is positioned downstream of the cone 540 and includes top and bottom seal backing rings 552 and 554, respective to opposite sides thereof. The top backing ring 552 includes a cylindrical extension extending 556 therefrom sized to be received within the annular cavity 546 wherein the outer cylindrical extension 544 and inner cylindrical extension are secured to each other with shear pins 558 operable to be sheared by a sufficiently large upward force applied through the wireline to release the collet arms 214 and seal 550 so as to facilitate removal of the apparatus in the event of a problem or emergency. The bottom backing ring 554 is engaged by a seal actuating piston 560 located around the main mandrel 500 within a seal engagement chamber 564. The seal engagement chamber 564 is in fluidic communication with the first pressurizing passage 484 so as to bias the seal actuating piston 450 towards the top seal backing ring 552 thereby compressing the seal 550 between the top and bottom seal backing rings 552 and 554 upon pressurization of this passage as will be more fully set out below.

As illustrated in FIG. 24, the bridge plug setting and testing section 208 also includes a testing fluid injector 600 adapted to discharge a marker fluid into the annulus between the apparatus 200 and the wellbore so as to enable the apparatus to test the integrity of the seal 550 as well as the bridge plug and wellbore wall as will be more fully described below. The injector 600 comprises an injector bore 602 extending between first and second ends, 604 and 606, respectively and having an injector piston 610 therein. The injector bore 602 is in fluidic communication with the second pressurizing passage 488 through bore 606 in the main mandrel 500. The second end 606 of the injector bore is in fluidic communication with the exterior of the apparatus 200 through an injector check valve 612 adapted to permit a quantity of the marker fluid to be passed therethrough when a sufficient pressure is achieved in the second pressurizing passage 488 and therefore also within the injector bore 602. By way of non-limiting example, the pressure required to inject the marker fluid may be selected to be similar to or above the test pressure such as, by way of non-limiting example, 1000 psi above the pressure required to pressurize the annulus between the apparatus 200 and the well bore 18 as set out below.

The injector 600 also includes an annular reservoir 620 formed around the main mandrel extending between first and second ends, 622 and 624, respectively. The annular reservoir 620 includes an annular reservoir piston 626 therein and may be initially located proximate to the first end 622 thereof wherein the remainder of the annular reservoir 620 is filled with a quantity of the marker fluid. The first end 622 is in fluidic communication with the first pressurizing passage 484 through connection passage 628 and charging check valve 630. The charging check valve 630 is adapted to permit fluid from the first pressurizing passage 484 to enter the first end 622 of the annular reservoir 620 upon a sufficient pressure being achieved. The second end 624 of the annular reservoir 620 is in fluidic communication with the second end 606 of the injector bore 602. The injector 600 may also include fill ports, as are commonly known for refilling the annular reservoir 620 with a replacement quantity of the marker fluid. The marker fluid may be selected to be any know fluid which can be detected as different from the existing fluid within the wellbore, such as, by way of non-limiting example, saline or oil.

Figure 25:
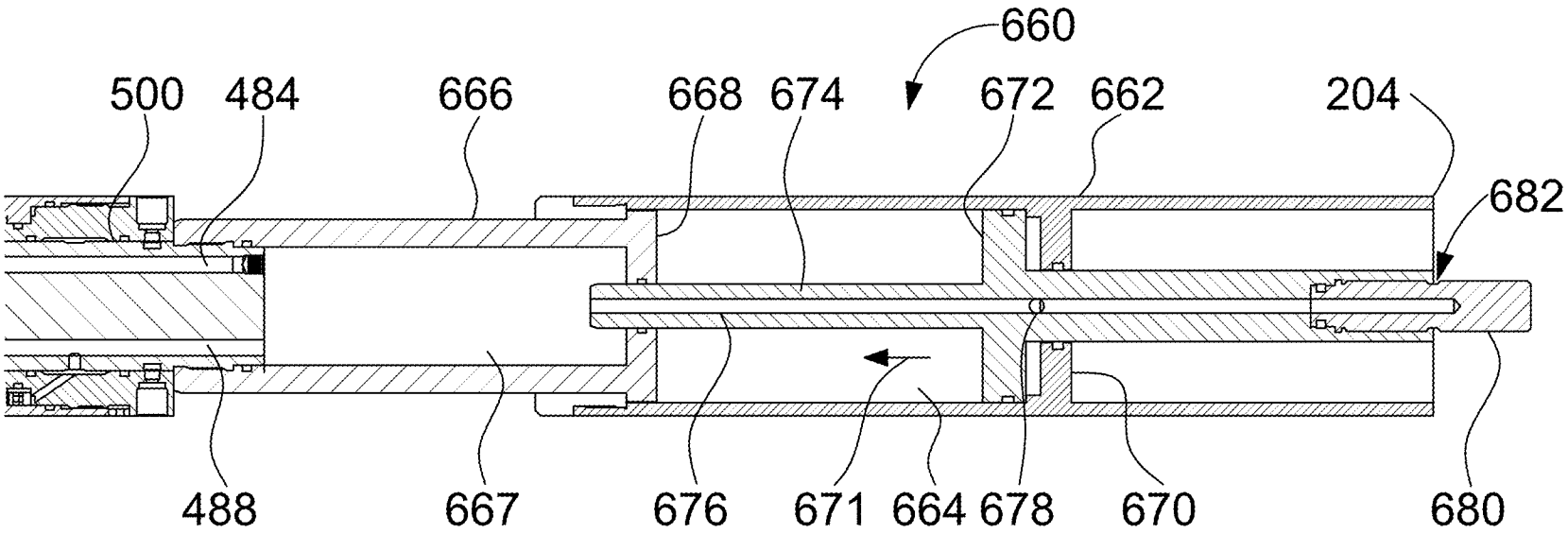
FIG. 25 is a top plane cross-sectional view of the bridge plug piston taken along the line 8-8 of FIG. 5.

Turning now to FIG. 25, the bridge plug actuator 660 is illustrated at a second end 204 of the apparatus. The bridge plug actuator 660 comprises an outer housing 662 securable to the main mandrel 550 and forming an inner cylinder 664 therein. As illustrated in FIG. 25, the outer housing may include an extension 666 spanning to the main mandrel 550 which includes a first end wall 668 at a top end of the cylinder 664. A second end wall 670 extends inwardly from the outer housing 662 to define the bridge plug actuation cylinder 664 therebetween. The bridge plug actuator 660 includes a piston 672 within the bridge plug actuation cylinder 664 with a shaft 674 having a blind bore 676 extending therethrough to both directions from the piston 672. In particular the shaft 674 has a sufficient length to extend through the first and end walls 668 and 670 at all positions of the piston 672. The blind bore 676 extend to a transfer cavity 667 within the extension 666. As illustrated in FIG. 25, the second pressurizing passage 448 extends to the end of the main mandrel 500 and therefore is in fluidic communication with the transfer cavity 667 whereas the first pressurizing passage 484 is blocked. The blind bore 676 also includes actuation ports 678 extending through the shaft 674 into the region between the second end wall 670 and the piston 672 so as to displace the piston upward in a direction generally indicated at 671 when the second pressurizing passage 488 is pressurized.

A bridge plug connector 680 is provide at the distal end of the shaft 674 which includes the blind bore 676 therein and a narrowed or necked portion 682 at a position where the blind bore also passes therethrough.

In operation, a bridge plug (not shown) as are commonly known may be secured to the bridge plug connector 680. A user then locates the apparatus at a desired location in the well to be tested and abandoned. Thereafter, the operator pulls up on the wireline 18 to drag the collets 214 against the well bore so as to radially shift the collet pins 510 into the long bottom J-slots 530 thereby permitting the collet cage 218 and the collet arms 214 to shift towards the cone 540. Further upward motion of the main mandrel 550 will pull the cone under the collet arms 214 further engaging the distal ends 217 thereof into the wellbore wall thereby fixing the location of the collet arms within the wellbore. It will be appreciated that during such setting motion, the first and second valve manifold rods 456 and 458 may be positioned as illustrated in FIG. 18 so as to prevent any fluid leaving the central pump cavity 308 through the valve supply passage 312 and therefore will also prevent movement of the pump mandrel 290 relative to the main mandrel 500.

Figure 26:
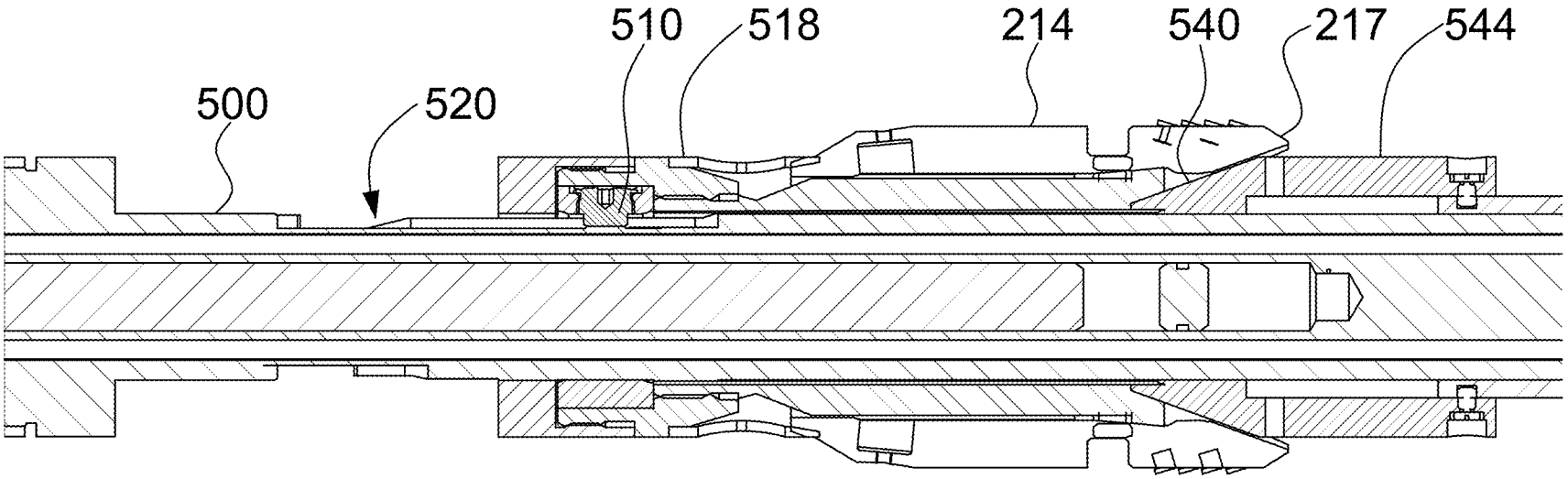
FIG. 26 is a top-plane cross-sectional view of the slip collet in a retention position taken along the line 8-8 of FIG. 5.

Once the collet arms 214 are set, the first and second valve manifold rods 456 and 458 may be positioned as illustrate in FIG. 19. In such position, movement of the pump mandrel 290 relative to the main mandrel 500 will be permitted thereby pressurizing the first pressurization passage 484 by the movement of the pump mandrel 290. Such pressurization will enter the seal engagement chamber 564 so as to displace the seal piston and compress the top and bottom retaining rings 552 and 554 together thereby compressing and expanding the seal into contact with the wellbore wall. The pressurization of the first pressurization passage 484 will also enter the first end 662 of the annular reservoir 620 thereby displacing the annular piston 626 and pressurizing the injection cylinder 602 as well as ensuring the injection piston 610 is retraced Once the seals are set, the first and second valve manifold rods 456 and 458 may be moved to the positions illustrated in FIG. 20 to pressurize the second pressurization passage 488 and de-couple the first pressurization passage 484 from the valve supply passage 312. As the second pressurizing passage 488 is pressurized, the piston 672 is displaced upwards in a direction generally indicated at 671 until the bridge plug is engaged upon the second end 204 of the apparatus to extend or engage the bridge plug as is commonly known. Thereafter further pressurizing of the second pressurizing passage 480 will increase the pressure between the piston 672 and the second wall 670 until the force applied to the shaft is sufficient to rupture or break the shaft at the necked portion 682 as illustrated in FIG. 26. At that time, the pressure within the second pressurization passage 488 is permitted to enter the annulus between the apparatus 200 and the wellbore between the seal 550 and the bridge plug. Pressure transducers, which may be located at any suitable location in the apparatus, such as, by way of non-limiting example, at the distal end of the main mandrel 500 or within the threaded fastener passage 264 so as to measure the pressure within the central pump cavity 308 or valve supply passage 312 may be provided to measure and log the pressure within the wellbore annulus to determine if there is a leak within this region of the wellbore or past the seal 550 or bridge plug. Further pressurizing of the annulus may thereafter be provided by additional pumping of the pump mandrel 290 as set out below.

Additionally, while the first and second valve manifold rods 456 and 458 are positioned as illustrated in FIG. 20, the second pressurizing passage 488 will introduce the pressurized fluid to the first end 604 of the injector cylinder to bias the injector piston 610 towards the second end 606 of the injector cylinder. Such movement of the injector piston 610 will be resisted until the pressure within the injector cylinder 602 is sufficient to overcome the spring in the injector check valve 612 at which time the marker fluid contained therein will be ejected into the annulus. Marker fluid sensors located upstream of the seal 550, such as, by way of non-limiting example, on the frustoconical surface of the cone, thereafter monitor for the presence of the marker fluid to determine if there is a leak past the seal 550. It will be appreciated that the pressure within the annulus may be maintained for a predetermined length of time to determine if there is a leak therefrom.

Figure 27:
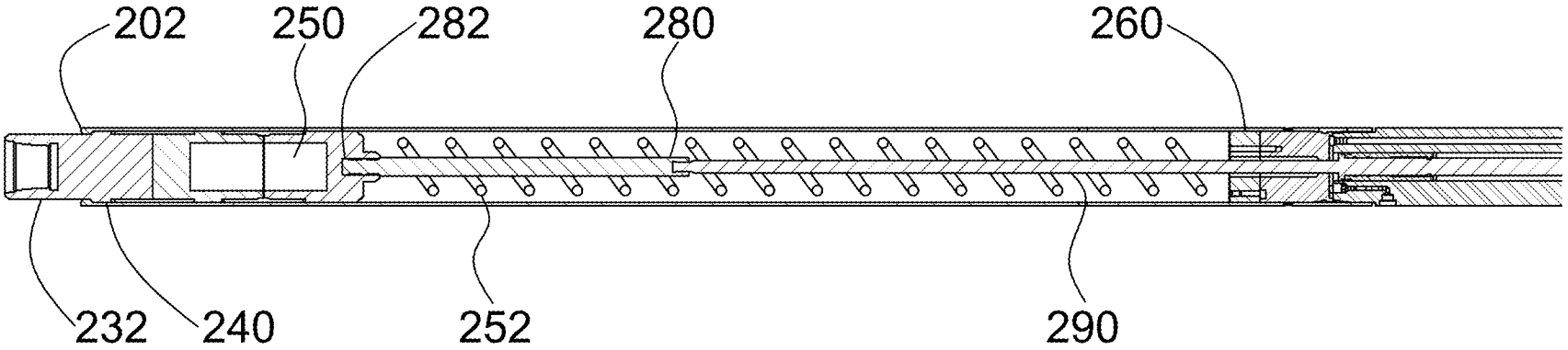
FIG. 27 is a top-plane cross-sectional view of the top connection section in a fully extended low-pressure pumping position taken along the line 8-8 of FIG. 5.
Figure 28:
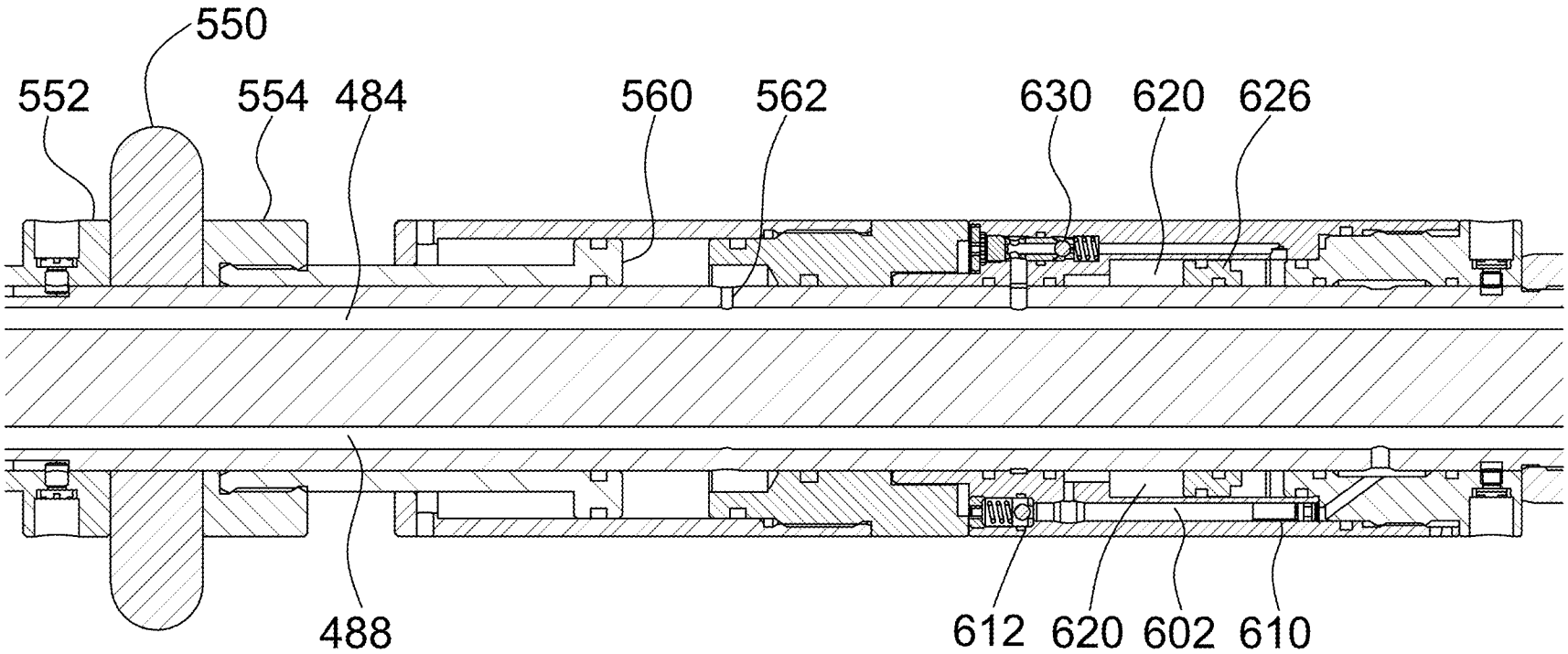
FIG. 28 is a top-plane cross-sectional view of the sealing element and fluid test chamber in a set position taken along the line 8-8 of FIG. 5.
Figure 29:
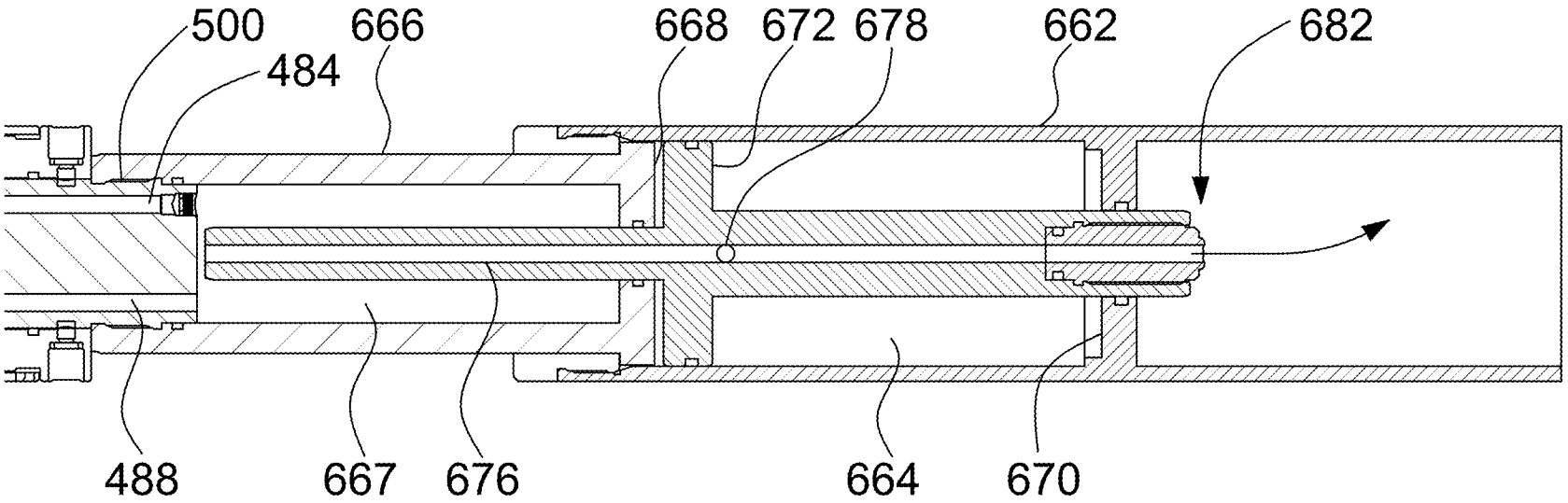
FIG. 29 is a top-plane cross-sectional view of the bridge plug piston in a set and pressure testing position taken along the line 8-8 of FIG. 5.

With reference to FIGS. 11 and 27, the pump mandrel 290 may be operated to pressurize the first or second pressurizing passages 484 or 488 as set out above by lifting up on the first end connector 232 with the wireline 18. Such movement of the first end connector 232 will also lift up the pump top rod 280 and pump mandrel 290 so as to displace the pump mandrel 290 and releasable collar 330 within the central pump cavity 308 thereby displacing the fluid contained therein through the valve supply passage 312, the use of which is set out above. When the pump mandrel has reached the end of its stroke as illustrated in FIG. 27, the wireline 18 may then be lowered permitting the pump mandrel to return to the initial position as illustrated in FIG. 11. During this movement, the fluid intake passage 310 and intake check valve 316 permit fluid surrounding the apparatus 200 to enter the central pump cavity 308 so as to provide the next amount of fluid to be discharged into the valve supply passage 312 during the next stroke from the position illustrated in FIG. 11 to the position illustrated in FIG. 27. As many strokes as necessary to pressurize the apparatus 20 may be utilized.

Figure 30:
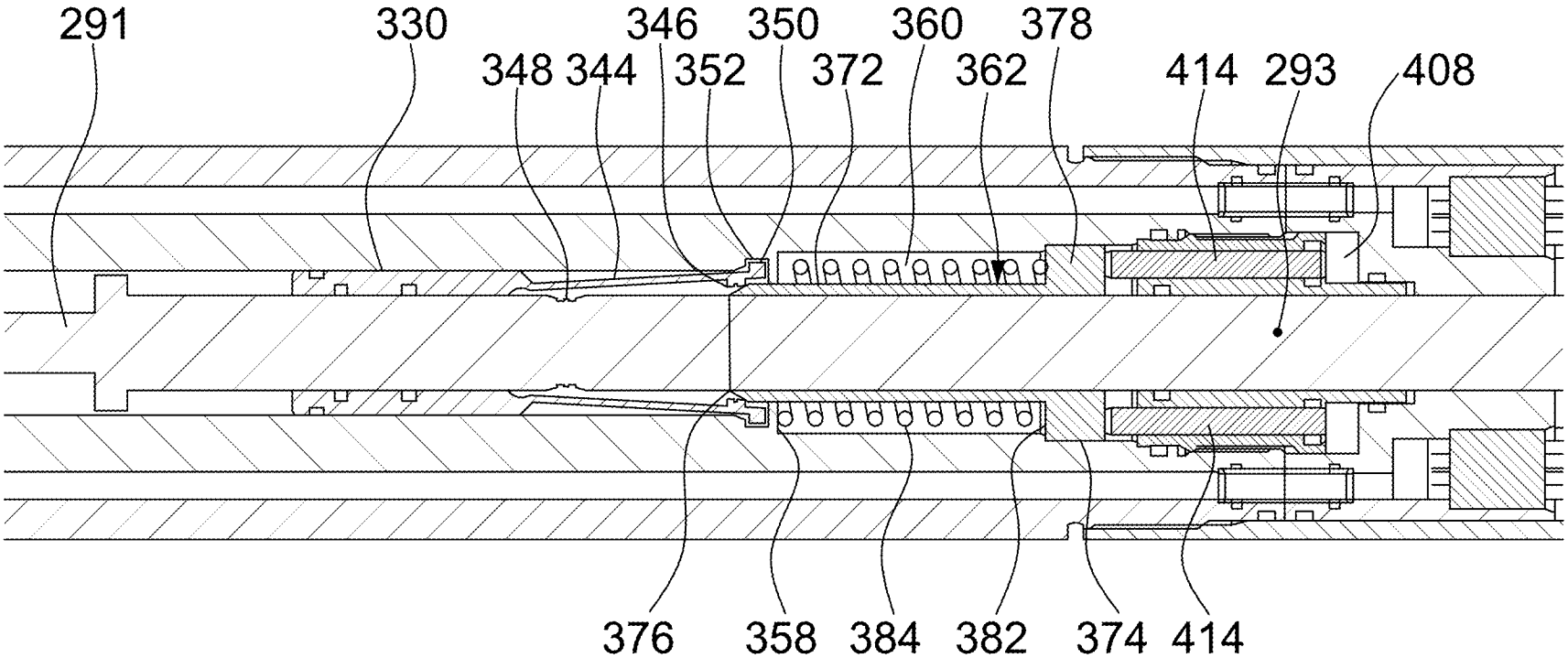
FIG. 30 is a detailed side plane cross-sectional view of the releasable pump collar in a high-pressure pumping position taken along the line 6-6 of FIG. 5.
Figure 31:
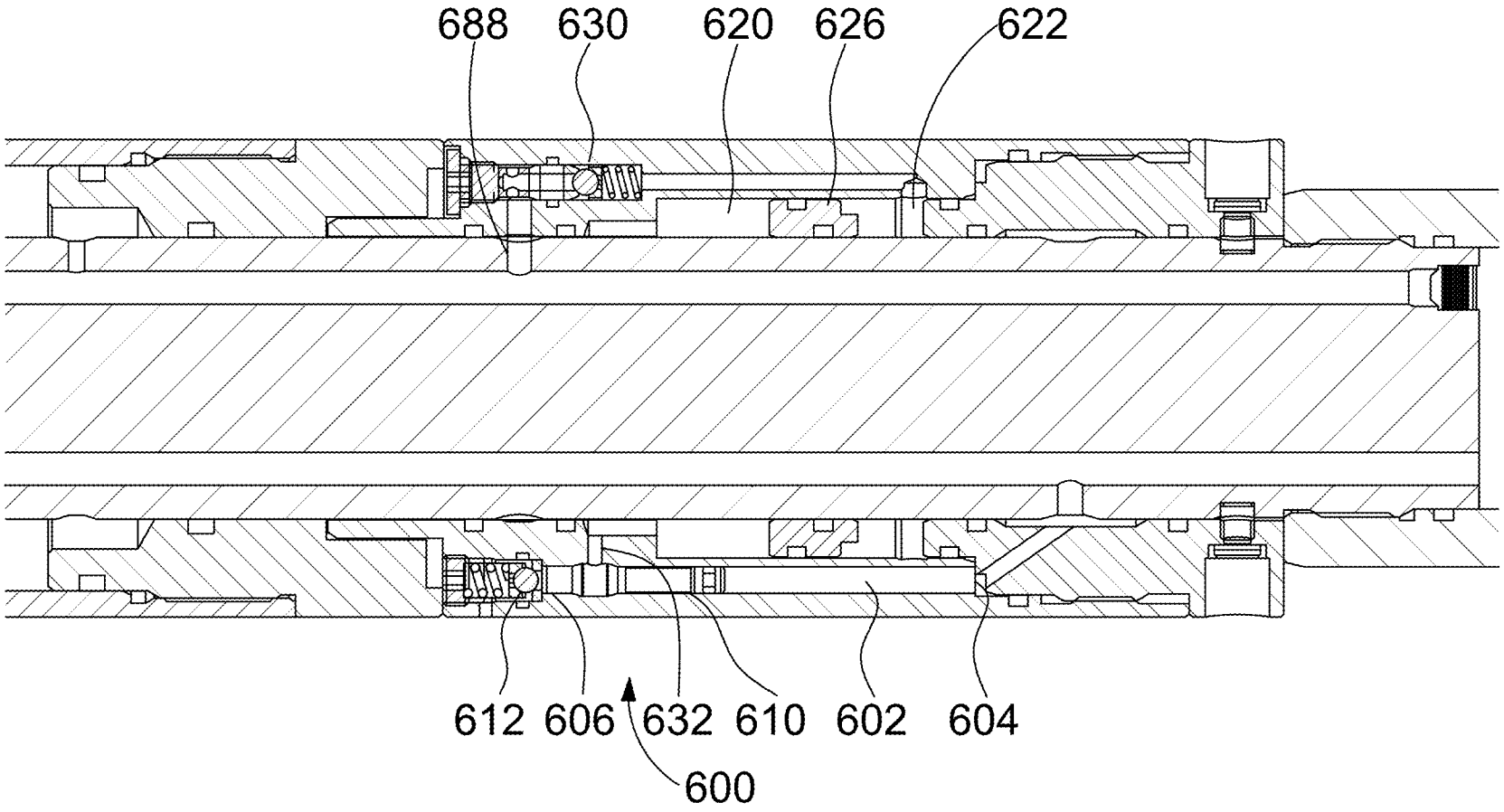
FIG. 31 is a detailed top-plane cross-sectional view of fluid test chamber in an injected position taken along the line 8-8 of FIG. 5.

As illustrated in FIGS. 13, 14 and 30 upon reaching a predetermined pressure, which may correspond to the maximum pull rating of the wireline 18, the pressure passing through the valve supply passage 316 and therefore into the annular pin control cavity 408 will exert a pressure upon the high pressure pump pins 414 so as to overcome the second stage spring 384 thereby moving the tapered tip 376 and wedge portion 372 of the pump unlock sleeve 362 as illustrated in FIG. 30. In this position the pump unlock sleeve 362 will disengage the first state inner locking ridges 346 from the first state locking groove 348 and engaging the second state outer locking blocks 350 within the second stage annular locking groove. Such position will thereafter decouple the releasable collar 330 from the pump mandrel 290 thereby permitting the pump mandrel 290 to move independently of the releasable collar. It will be appreciated that in the first stage as illustrated in the configuration of FIGS. 13 and 14, the pump volume of the pump mandrel 290 will comprise the volume of the central pump cavity 308 minus the volume of the pump mandrel 290. It will be further appreciated that in the second stage as illustrated in the configuration of FIG. 30, the pump volume will thereafter be the difference in volume between the first and second stage portions 291 and 293. It will be appreciated that such reduction in the pumping volume at the second stage as illustrated in FIG. 30 will require less force on the wireline 18 thereby permitting a greater pressure to be developed in the system while remaining within the weight ratings for the wireline 18.

Turning now to FIG. 21, once a bridge plug has been set and the wellbore pressure tested, the first and second valve manifold rods 456 and 458 may be positioned as illustrated in FIG. 21 to release the pressure within each of the first and second pressurizing passages 484 and 488. It will be appreciated that such release will permit the releasable collar 330 to re-engage upon the pump mandrel 290. Such release will also vent the fluid within the seal engagement chamber 564 so as to permit the pressure upon the seal 550 to be released thereby disengaging itself from the wellbore wall. Subsequent downward movement of the first end connector 232 will displace the collet pins 510 within the J-slots 520 to the end of the lower slots 522 so as to permit the cone 540 to be withdrawn from under the collet arms 214 thereby disengaging them from the wellbore. At such time, the apparatus may thereafter be removed from the wellbore or moved to a different position as desired. Optionally, the apparatus 200 may include a burst disk (now shown) at a location along the valve supply passage 312 or any other location in fluidic communication therewith such that an operator may over pressurize the valve supply passage 312 with the pump mandrel 290 so as to rupture the burst disk thereby venting the pressure within the system to allow removal of the apparatus.

Figure 33:
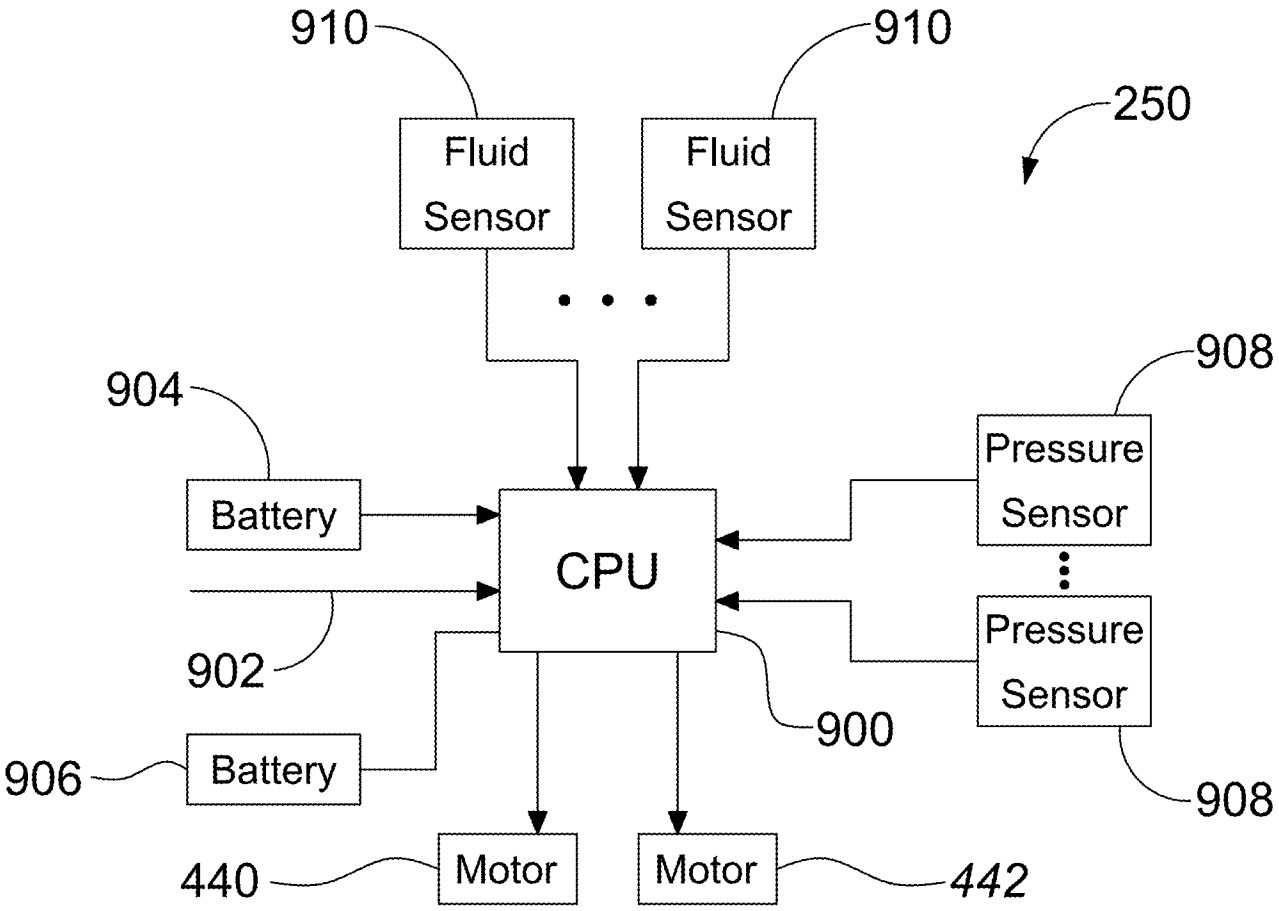
FIG. 33 is a schematic of the control system for use in the wireline abandonment tool.

Turning now to FIG. 33, the electronics control system 250 includes a processor circuit 900 operable to receive control signals 902 through the wireline 18 or through any other means as are commonly known. The processor circuit 900 may also include an associated battery 904 or may optionally be provided with a power input supplied through the wireline 18. As illustrated in FIG. 33, the processor circuit 900 receives signals from the pressure sensors 908 and test fluid sensors 910 as described above for measuring the pressure within the annulus between the apparatus 200 and the wellbore 10 and for monitoring for the presence of the marker fluid above the seal 550. The processor circuit 900 is also adapted to control the position of the first and second electric motors as set out above. The electronics control system 250 will include a memory 906 for storing the readings of the pressure and marker fluid sensors however it will be appreciated that the electronics control system 250 may also transmit these readings to an operator through known methods.

More generally, in this specification, including the claims, the term "processing circuit" is intended to broadly encompass any type of device or combination of devices capable of performing the functions described herein, including (without limitation) other types of microprocessing circuits, microcontrollers, other integrated circuits, other types of circuits or combinations of circuits, logic gates or gate arrays, or programmable devices of any sort, for example, either alone or in combination with other such devices located at the same location or remotely from each other. Additional types of processing circuit(s) will be apparent to those ordinarily skilled in the art upon review of this specification, and substitution of any such other types of processing circuit(s) is considered not to depart from the scope of the present invention as defined by the claims appended hereto. In various embodiments, the processing circuit 900 can be implemented as a single-chip, multiple chips and/or other electrical components including one or more integrated circuits and printed circuit boards.

Computer code comprising instructions for the processing circuit(s) to carry out the various embodiments, aspects, features, etc. of the present disclosure may reside in the memory 906. In various embodiments, the processing circuit 900 can be implemented as a single-chip, multiple chips and/or other electrical components including one or more integrated circuits and printed circuit boards. The processing circuit 900 together with a suitable operating system may operate to execute instructions in the form of computer code and produce and use data. By way of example and not by way of limitation, the operating system may be Windows-based, Mac-based, or Unix or Linux-based, among other suitable operating systems. Operating systems are generally well known and will not be described in further detail here.

Memory 906 may include various tangible, non-transitory computer-readable media including Read-Only Memory (ROM) and/or Random-Access Memory (RAM). As is well known in the art, ROM acts to transfer data and instructions uni-directionally to the processing circuit 900, and RAM is used typically to transfer data and instructions in a bi-directional manner. In the various embodiments disclosed herein, RAM includes computer program instructions that when executed by the processing circuit 900 cause the processing circuit 900 to execute the program instructions described in greater detail below.

While specific embodiments of the invention have been described and illustrated, such embodiments should be considered illustrative of the invention only and not as limiting the invention as construed in accordance with the accompanying claims.

What is claimed is:

1. A well abandonment tool comprising:

an elongate housing extending between top and bottom ends locatable within a wellbore having a longitudinal pumping cylindrical bore therein;

a wellbore seal located around said housing operable to engage upon said wellbore and to be expanded into contact therewith upon an upward motion of said housing so as to seal an annulus between said housing and said wellbore;

a bridge plug engagement connector adapted to secure a bridge plug thereto at a position below said bottom end of said housing; and a pumping piston longitudinally moveably located within said longitudinal pumping cylindrical bore, said pumping piston being suspended from a wireline wherein longitudinal movement of said pumping piston discharges a fluid into a bridge plug activation chamber having a movable cylinder adapted to draw said bridge plug engagement connector against said bottom end of said housing so as to expand said bridge plug into engagement with said wellbore.

2. The well abandonment tool of claim 1 wherein said bridge plug engagement connector includes a frangible portion and wherein said bridge plug engagement connector includes a cavity therein through said frangible portion in fluidic communication with said bridge plug activation chamber.

3. The well abandonment tool of claim 2 further comprising at least one valve adapted to selectably direct said fluid from said longitudinal pumping cylindrical bore to said bridge plug activation chamber.

4. The well abandonment tool of claim 3 wherein said at least one valve is adapted to isolate said fluid within said longitudinal pumping cylindrical bore so as to prevent movement of said pumping piston therein.

5. The well abandonment tool of claim 3 further comprising a testing fluid injector assembly adapted to discharge a quantity of a testing fluid therefrom into a pressurized annulus between said housing and said wellbore and between said wellbore seal and said bridge plug.

6. The well abandonment tool of claim 5 wherein said testing fluid injector comprises an injector cylinder having an injector piston therein and a reservoir cylinder having a reservoir piston therein.

7. The well abandonment tool of claim 6 wherein said reservoir piston is displaced by said fluid directed to said bridge plug activation chamber so as to pressurize said injector cylinder.

8. The well abandonment tool of claim 6 wherein said at least one valve is adapted to selectably direct said fluid to said injector piston so as to displace said piston therein so as to discharge said testing fluid therefrom.

9. The well abandonment tool of claim 8 wherein said injector cylinder includes a check valve having an opening pressure selected to prevent said discharge of said testing fluid before said bridge plug is set.

10. The well abandonment tool of claim 3 further comprising a processing circuit adapted to control said operation of said at least one valve.

11. The well abandonment tool of claim 10 wherein said processing circuit is adapted to monitor said pressure within said pressurized annulus and presence of said testing fluid at said test sensors thereabove.

12. The well abandonment tool of claim 1 wherein said pumping piston includes a first stage ring selectably secured therearound so as to provide an increased pumping volume when secured thereto.

13. The well abandonment tool of claim 12 wherein said first stage ring includes a plurality of piston collet arms each having a radially inwardly extending protrusion engaged within an annular piston groove on said pumping piston so as to secure said second stage ring to said pumping piston.

14. The well abandonment tool of claim 13 wherein said each of said pumping piston collet arms includes a radially outwardly extending protrusion adapted to be engaged within an annular cylinder groove in said longitudinal pumping cylindrical bore.

15. The well abandonment tool of claim 14 further comprising a first stage disengagement wedge ring adapted to be slidably located under said plurality of piston collet arms so as to disengage said inwardly extending protrusions from said annular piston groove and engage said outwardly extending protrusions into said annular cylinder groove.

16. The well abandonment tool of claim 15 further comprising at least one spring biased second stage piston fluidically connected with said output from said longitudinal pumping cylindrical bore so as to displace said first stage disengagement wedge ring upon said pumping cylinder reading a predetermined pressure.

17. The well abandonment tool of claim 1 further comprising a plurality of slip arms expandable into engagement with a wellbore wall by a cone located around said housing between said slip arms and said wellbore seal.

18. The well abandonment tool of claim 17 wherein said slip arms are retained around said housing on a slip arm ring.

19. The well abandonment tool of claim 18 wherein said slip arm ring includes at least one radially inwardly extending j-pin, wherein said slip arm ring is selectably longitudinally positionable along said housing by rotating said j-pin into alternating short and long longitudinal slots on an outer surface of said housing.

20. The well abandonment tool of claim 17 wherein said wellbore seal is longitudinally compressed between said cone and a wellbore seal backing protrusion extending from said housing.

21. The well abandonment tool of claim 20 further comprising a wellbore seal retention piston engaged upon a bottom end of said wellbore seal wherein said wellbore retention piston is biased towards said wellbore seal by said pressure of said fluid directed towards said bridge plug activation chamber.

22. A method for abandoning a wellbore comprising:

locating a housing within a wellbore above a location to be sealed;

pulling upwardly on a wireline secured to a pumping piston within said housing so as to draw a bottom end of said housing upwards thereby extending a seal element located along said housing into engagement with said wellbore;

pulling upwardly on said wireline so as to displace said pumping piston within a cylindrical bore within said housing so as to discharge a fluid therefrom;

directing said discharged fluid into a bridge plug activation chamber adapted to draw a bridge plug engagement connector against a bottom end of said housing so as to expand a bridge plug secured thereon into engagement with said wellbore.

23. The method of claim 22 further comprising further pressurizing said bridge plug activation chamber after said bridge plug is secured so as to shear a frangible portion of said bride plug engagement connector releasing said fluid into a pressurized annulus between said housing and said wellbore between said seal and said bridge plug.

24. The method of claim 22 further comprising injecting a quantity of a testing fluid into said pressurized annulus and monitoring above said seal for a presence of said testing fluid.

25. The method of claim 24 further comprising monitoring a pressure within said pressurized annulus.

* * * * *